US006346018B1

(12) United States Patent
Watanabe

(10) Patent No.: US 6,346,018 B1
(45) Date of Patent: Feb. 12, 2002

(54) ARRANGEMENT FOR OUTBOARD MOTOR

(75) Inventor: Hitoshi Watanabe, Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/676,044

(22) Filed: Sep. 28, 2000

(30) Foreign Application Priority Data

Sep. 29, 1999 (JP) ..... 11-275885

(51) Int. Cl.[7] ..... B63H 20/32

(52) U.S. Cl. ..... 440/77; 440/88; 123/198 R; 123/195 P

(58) Field of Search ..... 440/88, 89, 77, 440/900; 123/198 R, 195 P, 195 A, 197.4, 179.16

(56) References Cited

U.S. PATENT DOCUMENTS

| | | | |
|---|---|---|---|
| 5,041,034 | A | 8/1991 | Sakamoto |
| 5,048,467 | A | 9/1991 | Kojima |
| 5,207,190 | A | 5/1993 | Torigai et al. |
| 5,279,267 | A | 1/1994 | Takahashi et al. |
| 5,349,928 | A | 9/1994 | Takahashi et al. |
| 5,513,606 | A | 5/1996 | Shibata |
| 5,769,039 | A | 6/1998 | Taue et al. |
| 5,873,332 | A | 2/1999 | Taue et al. |
| 5,893,783 | A | 4/1999 | Hiraoka et al. |
| 5,941,205 | A | 4/1999 | Hiraoka et al. |
| 5,904,604 | A | 5/1999 | Suzuki et al. |
| 5,915,363 | A | 6/1999 | Iwata et al. |

OTHER PUBLICATIONS

Co–pending patent application: Serial No. 09/688,511, filed Oct. 18, 2000, entitled Engine Throttle Valve Linkage, in the name of Atsushi Isogawa and Yukinori Kashima, and assigned to Sanshin Kogyo Kabushiki Kaisha.

Co–pending patent application: Serial No. 09/664,513, filed Sep. 18, 2000, entitled Lubrication System for Outboard Motor Engine, in the name of Toshihiro Nozue, and assigned to Sanshin Kogyo Kabushiki Kaisha.

Co–pending patent application, Serial No. 09/664,514, filed Sep. 18, 2000, entitled Four–Cycle Engine, in the name of Hitoshi Watanabe, and assigned to Sanshin Kogyo Kabushiki Kaisha.

*Primary Examiner*—Jesus D. Sotelo
(74) *Attorney, Agent, or Firm*—Knobbe, Martens Olson & Bear, LLP

(57) ABSTRACT

An outboard motor comprises an internal combustion engine and a protective cowling that surrounds the engine. The cowling comprises at least an upper portion and a lower portion. The engine comprises a cylinder block that defines a cylinder bore. A cylinder head member is fixed at one end of the cylinder block and encloses one end of the cylinder bore. A crankcase member is fixed at the other end of the cylinder block and encloses the other end of the cylinder bore. The crankcase member forms a crankcase chamber. A piston is positioned within the cylinder bore. A crankshaft is rotably journaled in the crankcase chamber and is connected to the piston. The piston, the cylinder bore and the cylinder head together define a combustion chamber. The cylinder block, the cylinder head member and the crankcase member together defining an engine body. A first air intake conduit communicates with the engine and extends generally along a side of the engine body. The first air intake conduit communicates with an intake silencer located proximate the crankcase member. The engine further comprises a starter motor, an electronic control unit and a fuel supply system. The fuel supply system comprises a vapor separator and a fuel injector. The starter motor, the electronic control unit, the vapor separator and the fuel injectors are located in a space defined between the intake silencer, the first air intake conduit and the engine body.

22 Claims, 18 Drawing Sheets

ARRANGEMENT FOR OUTBOARD MOTOR

PRIORITY INFORMATION

This invention is based on and claims priority to Japanese Patent Application No. Hei 11-275885, filed Sep. 29, 1999, the entire contents of which are hereby expressly incorporated by reference.

BACKGROUND OF THE INVENTION

1. Field of the Invention

This invention relates to an improved arrangement of an outboard motor, and more particularly to an arrangement of an outboard motor that protects certain engine components.

2. Description of Related Art

Outboard motors are powered by an internal combustion engine. The engine is surrounded by a protective cowling. The protective cowling typically comprises an upper portion and lower portion, which are removably mounted to each other by coupling mechanisms, such as, for example, hooks. Accordingly, the upper portion can be removed from the lower portion such that the engine can be inspected and/or repaired.

A general problem associated with outboard motors is that the space within the cowling is extremely limited. In this limited space, many engine components must be disposed. For example, the engine includes many electrical components, which must be positioned in the limited space between the cowling and the engine. When the upper portion is removed from the lower portion, the coupling mechanism can contact and damage of these electrical components.

SUMMARY OF THE INVENTION

In accordance with one aspect of the present invention, an outboard motor comprises an internal combustion engine and a protective cowling that surrounds the engine. The cowling comprises at least an upper portion and a lower portion. The engine comprises a cylinder block that defines a cylinder bore. A cylinder head member is fixed at one end of the cylinder block and encloses one end of the cylinder bore. A crankcase member is fixed at the other end of the cylinder block and encloses the other end of the cylinder bore. The crankcase member forms a crankcase chamber. A piston is positioned within the cylinder bore. A crankshaft is rotably journaled in the crankcase chamber and is connected to the piston. The piston, the cylinder bore and the cylinder head together define a combustion chamber. The cylinder block, the cylinder head member and the crankcase member together defining an engine body. A first air intake conduit communicates with the engine and extends generally along a side of the engine body. The first air intake conduit communicates with an intake silencer located proximate the crankcase member. The engine further comprises a starter motor, an electronic control unit and a fuel supply system. The fuel supply system comprises a vapor separator and a fuel injector. The starter motor, the electronic control unit, the vapor separator and the fuel injectors are located in a space defined between the intake silencer, the first air intake conduit and the engine body.

In accordance with another aspect of the present invention, an outboard motor comprises an internal combustion engine and a protective cowling that surrounds the engine. The cowling comprises at least an upper portion and a lower portion. The engine comprises a cylinder block having a first cylinder bank and a second cylinder bank that are spaced apart from each other to form a V-configuration.

Each cylinder bank defines at least one cylinder bore. A cylinder head member encloses one end of the cylinder bores. A crankcase member is fixed at the other end of the cylinder block and encloses the other end of the cylinder bores. The crankcase member forms a crankcase chamber. Pistons are positioned within the cylinder bores. A vertically extending crankshaft is rotably journaled in the crankcase and is connected to the pistons. The pistons, the cylinder bores, and the cylinder head member together define combustion chambers. The cylinder block, the cylinder head member and the crankcase member together define an engine body. A first air intake conduit communicates with a first set of intake ports, which communicate with the combustion chambers of the first cylinder bank. The first intake ports being located on a starboard side of the first cylinder bank. The first air intake conduit extend from the first set of intake ports in a generally forward direction along a starboard side of the engine body. A second air intake conduit communicates with a second set of intake ports, which communicate with the combustion chambers of the second cylinder bank. The second intake ports are located on a port side of the second cylinder bank. The second air intake conduit extends from the second set of intake ports in generally forward direction along the port side of the engine body. The first and second air intake conduits communicate with an intake silencer located forward of the crankcase member, which is located forward of the cylinder head member. The engine further comprises a starter motor, an electronic control unit and a fuel supply system. The fuel supply system comprises a vapor separator and a fuel injector. The starter motor, the electronic control unit, the vapor separator and the fuel injectors being located in a space defined between the intake silencer, the first air intake conduit, the second air intake conduit and the engine body.

In accordance with a further aspect of the present invention, an outboard motor comprises an internal combustion engine and a protective cowling that surrounds the engine. The protective cowling comprises at least an upper and lower portion that are detachably coupled to each other by at least one coupling mechanism. The engine comprises a cylinder block that defines a cylinder bore. A cylinder head member is fixed at one end of the cylinder block and encloses one end of the cylinder bore. A crankcase member is fixed at the other end of the cylinder block and encloses the other end of the cylinder bore. The crankcase member forms a crankcase chamber. A piston is positioned within the cylinder bore. A crankshaft is rotably journaled in the crankcase chamber and is connected to the piston. The piston, the cylinder bore and the cylinder head together define a combustion chamber. The cylinder block, the cylinder head member and the crankcase member together define an engine body. The engine further comprises a starter motor, an electronic control unit and a fuel supply system. The fuel supply system comprises a vapor separator and a fuel injector. The outboard motor further comprises means for protecting the starter motor, the electronic control unit and the vapor separator from damage caused by the at least one coupling mechanism when the upper portion of the protective cowling is separated from the lower portion.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The drawings contain the following figures.

DETAILED DESCRIPTION OF THE PREFERRED EMBODIMENT OF THE INVENTION

Figure 1:
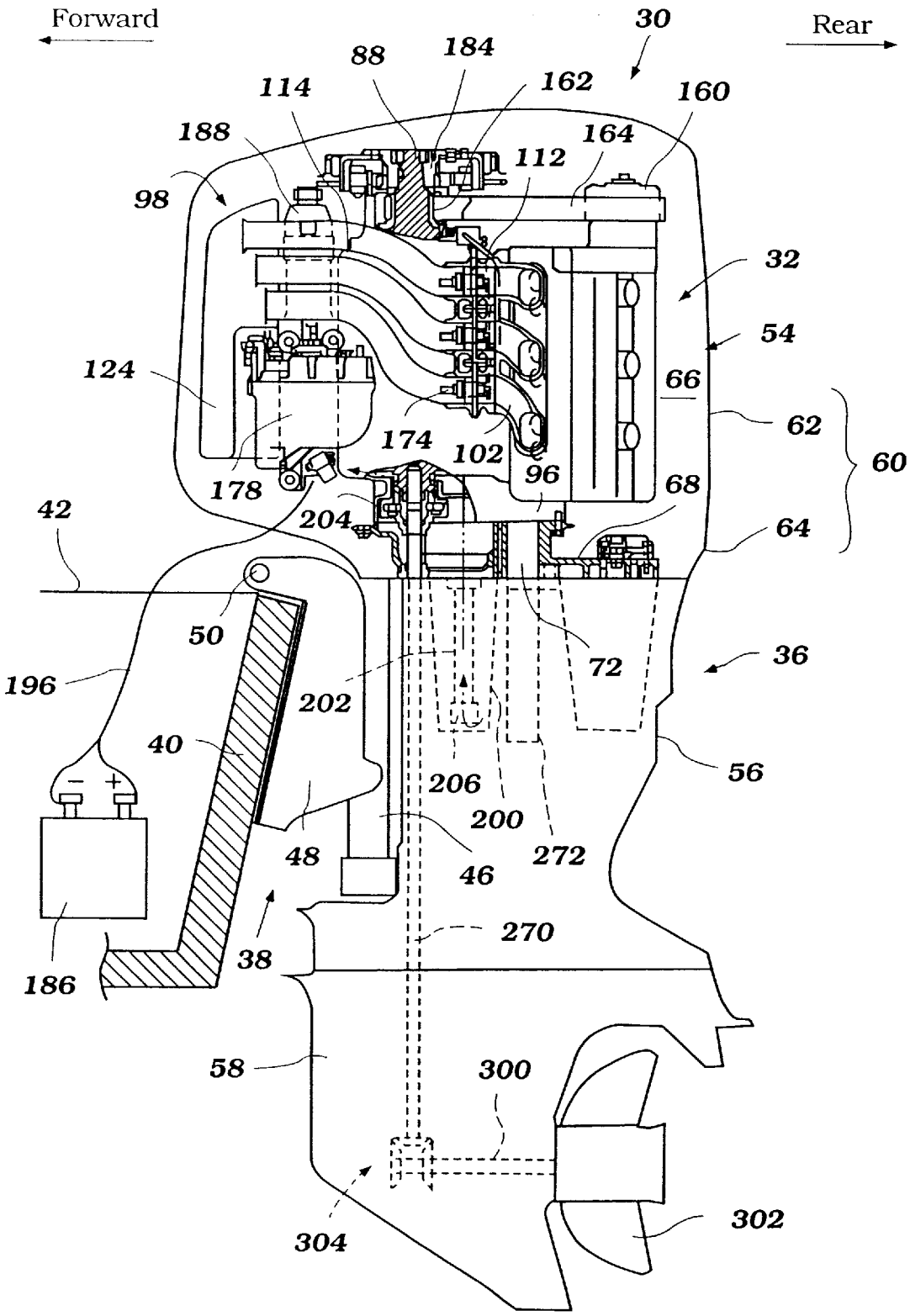
FIG. 1 is a side elevational view of an outboard motor with an engine having certain features and advantages according to the present invention.

With primary reference to FIG. 1, an outboard motor 30 employs an internal combustion engine 32 configured in accordance with a preferred arrangement of the present invention. Although the present invention is shown in the context of an engine for an outboard motor, various aspects and features of the present invention also can be applied to engines for other types of marine outboard drive units (e.g., a stem drive unit) and also to other engines (e.g., land vehicle engines and stationary engines).

In the illustrated arrangement, the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 resting on the surface of a body of water. The bracket assembly 38 comprises a swivel bracket 46, a clamping bracket 48, a steering shaft (not shown) and a pivot pin 50.

The steering shaft extends through the swivel bracket 46 and is affixed to the drive unit 36 with an upper mount assembly and a lower mount assembly (not shown). The steering shaft is pivotally journaled for steering movement about a generally vertically extending steering axis within the swivel bracket 46. A steering handle (not shown) extends upwardly and forwardly from the steering shaft to steer the drive unit 36. The clamping bracket 48 includes a pair of bracket arms spaced apart from each other and affixed to the transom 40 of the associated watercraft 42. The pivot pin 50 completes a hinge coupling between the swivel bracket 46 and the clamping bracket 48. The pivot pin 50 extends through the bracket arms so that the clamping bracket 48 supports the swivel bracket 46 for pivotal movement about a generally horizontally extending tilt axis of the pivot pin 50. Although not shown, a hydraulic tilt and trim adjustment system preferably is provided between the swivel bracket 46 and the clamping bracket 48 to tilt up and down and also for the trim adjustment of the drive unit 36.

As used through this description, the terms "fore," "front," "forward" and "forwardly" mean at or to the side of where the clamping bracket 48 is located, and the terms "aft" "rear," "reverse" and "rearwardly" mean at or to the opposite side of the front side, unless indicated otherwise or otherwise readily apparent from the context of use.

The drive unit 36 includes a power head 54, a driveshaft housing 56 and a lower unit 58. The power head 54 is disposed atop the drive unit 36 and includes the engine 32 and a protective cowling assembly 60. The protective cowling assembly 60 includes a top cowling member 62 and a bottom cowling member 64.

The protective cowling assembly 60 generally completely surrounds the engine 32 so as to enclose it in a closed cavity 66. The top cowling member 62 is detachably affixed to the bottom cowling member 64 with a conventional coupling mechanism (e.g., hook type) 65 (see FIGS. 2–4) so that the operator can access the engine 32 for maintenance or for other purposes. As is well known, the top cowling member 62 has an air intake port disposed on its rear and top portion. A pair of air intake ducts is provided at a position adjacent to the intake port so that ambient air enters the closed cavity 66 through the port and the intake ducts.

The bottom cowling member 64 has an opening at its bottom portion through which an upper portion of an exhaust guide member 68 extends. The exhaust guide member 68 is affixed atop the driveshaft housing 56. The bottom cowling member 64 and the exhaust guide member 68 thus generally form a tray. The engine 32 is placed onto this tray and is affixed to the exhaust guide member 68 so as to be supported thereby. A gasket 70 (FIG. 11) is interposed between the engine 32 and the exhaust guide member 68. The exhaust guide member 68 also has an exhaust passage 72 through which burnt charges (e.g., exhaust gases) from the engine 32 are discharged as described below.

Figure 3:
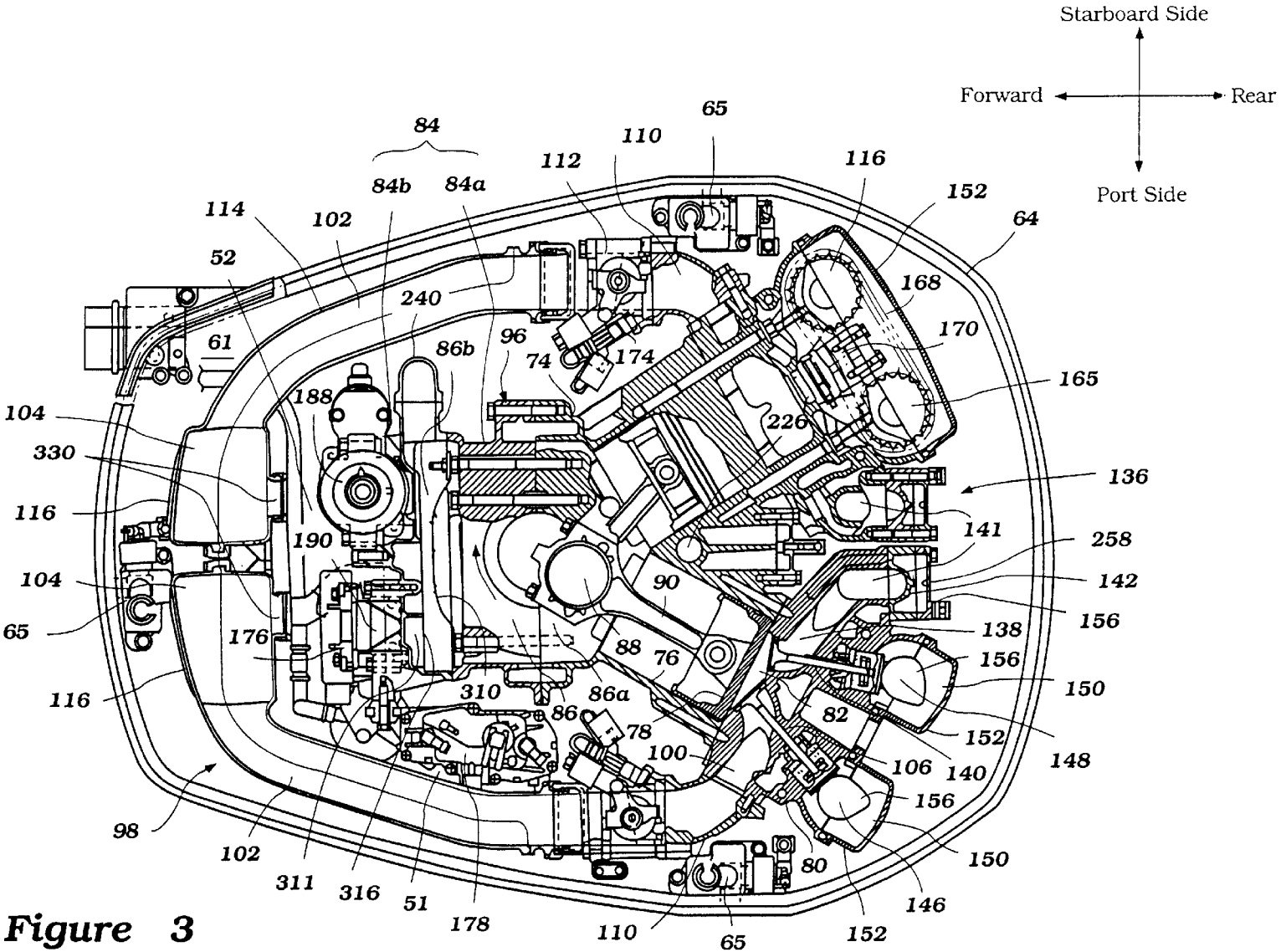
FIG. 3 is a top plan view of the engine of FIG. 1 with portions of the air induction system shown in section.
Figure 4:
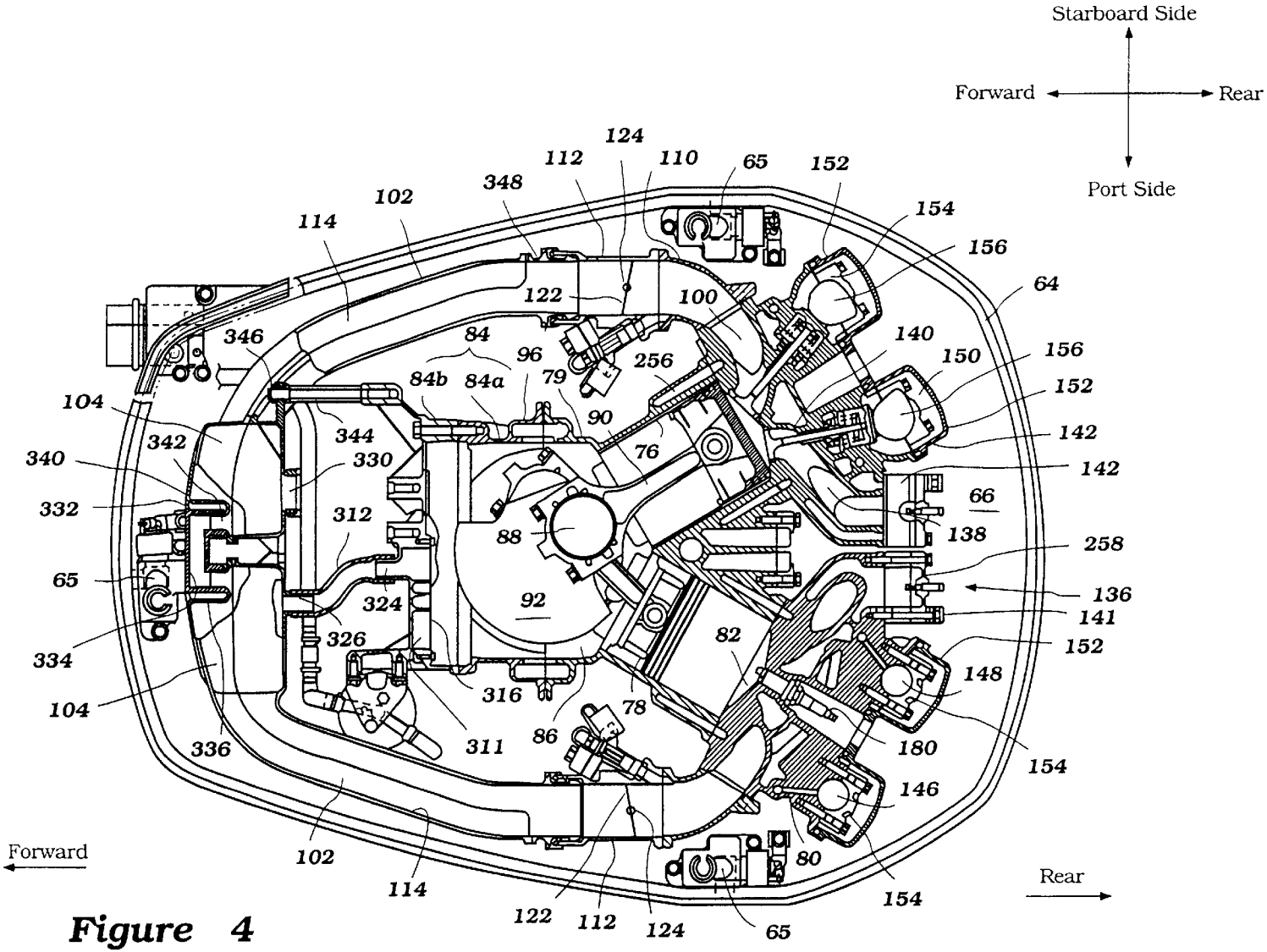
FIG. 4 is a top plan view of the engine shown in FIG. 1 illustrating another section of the air induction system.

With reference to FIGS. 3 and 4, the engine 32 in the illustrated arrangement operates on a four-stroke cycle combustion principle and powers a propulsion device. The engine 32 has a cylinder block 74. The cylinder block 74 defines six cylinder bores 76. The cylinder block 74 is generally configured as a V-shape to form two banks so that adjacent cylinder bores 76 are spaced apart horizontally from each other in a plan view. Each bank of the cylinder block 74 includes three cylinder bores 76 extending generally horizontally and spaced apart vertically from each other. That is, the engine 32 is a horizontal cylinder, V6 type. This type of engine, however, is merely exemplary of a type on which various aspects and features of the present invention can be used. Engines having other number of cylinders, having other cylinder arrangements, and operating on other combustion principles (e.g., crankcase compression two-stroke or rotary) are all practicable.

A piston 78 reciprocates in each cylinder bore 76. A pair of cylinder head members 80 is affixed to one ends of the cylinder block 74 for closing the cylinder bores 76 of the respective banks. The cylinder head members 80 define six combustion chambers 82 with the pistons 78 and the cylinder bores 76. Each bank has three combustion chambers 82.

Figure 11:
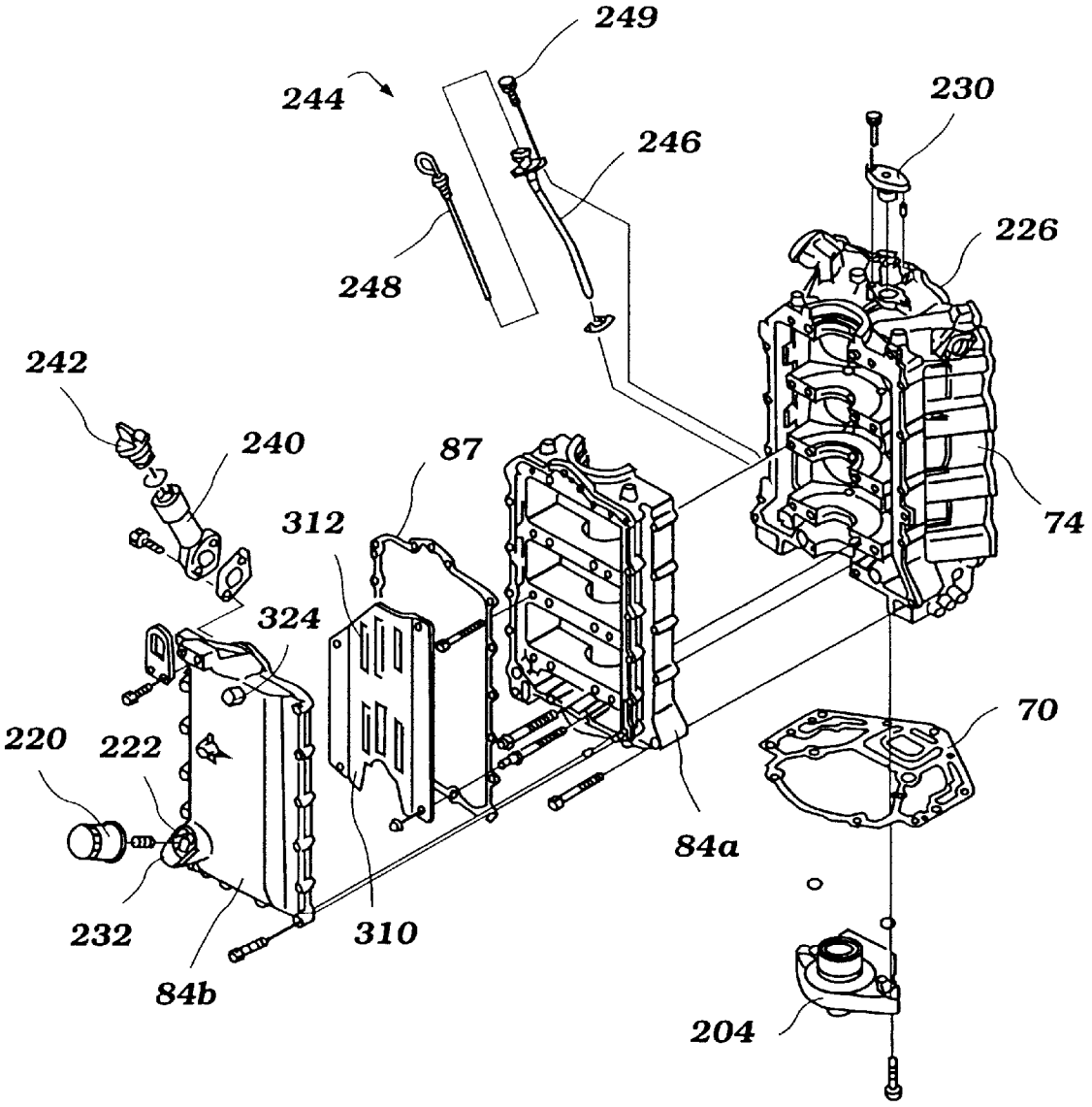
FIG. 11 is an exploded view of the engine including the cylinder block, the crankcase member, the crankcase cover, a baffle plate and the oil pump unit.

A crankcase assembly 84 closes the other ends of the cylinder bores 76 and defines a crankcase chamber 86 with the cylinder block 74. In the illustrated arrangement, the crankcase assembly 84 comprises two pieces, i.e., a crankcase member or inner member section 84*a* and a crankcase cover or outer member section 84*b*. The crankcase cover 84*b* is affixed to the crankcase member 84*a* via a gasket 87 (FIG. 11). The crankcase assembly 84, however, can be formed with a single piece.

Figure 5:
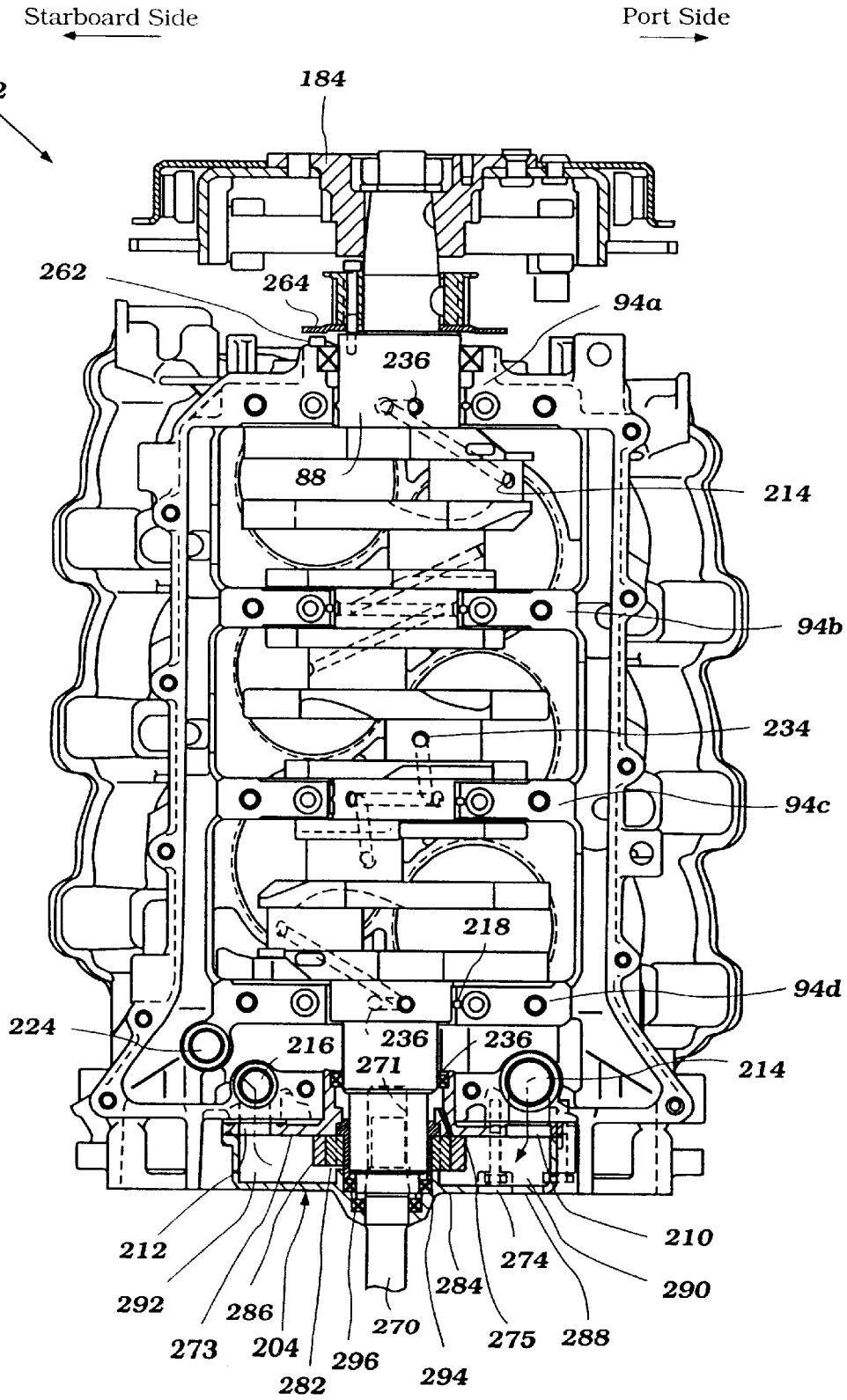
FIG. 5 is a partially sectioned front view of the engine without a crankcase member.

A crankshaft 88 extends generally vertically through the crankcase chamber 86. The crankshaft 88 is rotatably coupled with the respective pistons 78 by connecting rods 90 and thus rotates with the reciprocal movement of the pistons 78. The crankshaft 88 has counter weights 92 opposite to the pistons 78 so as to effectively balance with the total weight of the other side including expansion force received by the pistons 78. The crankshaft 88 is journaled by bearing blocks which are end portions of the cylinder block 74 and the crankcase member 84*a*. As best seen in FIG. 5, the bearing blocks comprise an top bearing portion 94*a*, in-between bearing portion 94*b*, 94*c* and a bottom bearing portion 94*d*. The crankcase assembly 84 and the crankcase chamber 86 will be described in greater detail below.

As best seen in FIG. 3, the crankcase assembly 84 is located at the most forward position. The cylinder block 74 and the cylinder head member 80 extend rearwardly from the crankcase assembly 84. The cylinder block 74, the cylinder head member 80 and the crankcase assembly 84 together define an engine body 96. Preferably, these major engine components 74, 80, 84 are made of an aluminum alloy.

The engine 32 includes an air induction system 98, which will be described with reference to FIGS. 2–4. The air induction system 98 introduces the air existing in the closed cavity 66 of the cowling assembly 60 to the combustion chambers 82. The air induction system 98 includes intake ports 100, a pair of intake passages 102 and a pair of plenum chambers 104.

As mentioned above, the illustrated engine 32 is a V-6 type engine. Accordingly, twelve intake ports 100 preferably are provided, six of which are disposed at the cylinder bank on the starboard side and another six of which are disposed at the other cylinder bank on the port side. That is, one cylinder bore 76 has two intake ports 100. The intake ports 100 are defined in the respective cylinder head members 80 on outer sides of the respective banks. The intake ports 100 are opened and closed by intake valves 106.

Three intake passages 102 preferably extend generally forwardly from the respective intake ports 100 of the starboard cylinder bank generally along a side surface of the cylinder block 74 and the crankcase assembly 84. Another three intake passages 102 extend generally forwardly from the intake ports 100 of the portside cylinder bank along the other side surface of the cylinder block 74 and the crankcase assembly 84. When each intake port 100 is opened, the corresponding intake passage 102 communicates with the associated combustion chamber 82.

Figure 7:
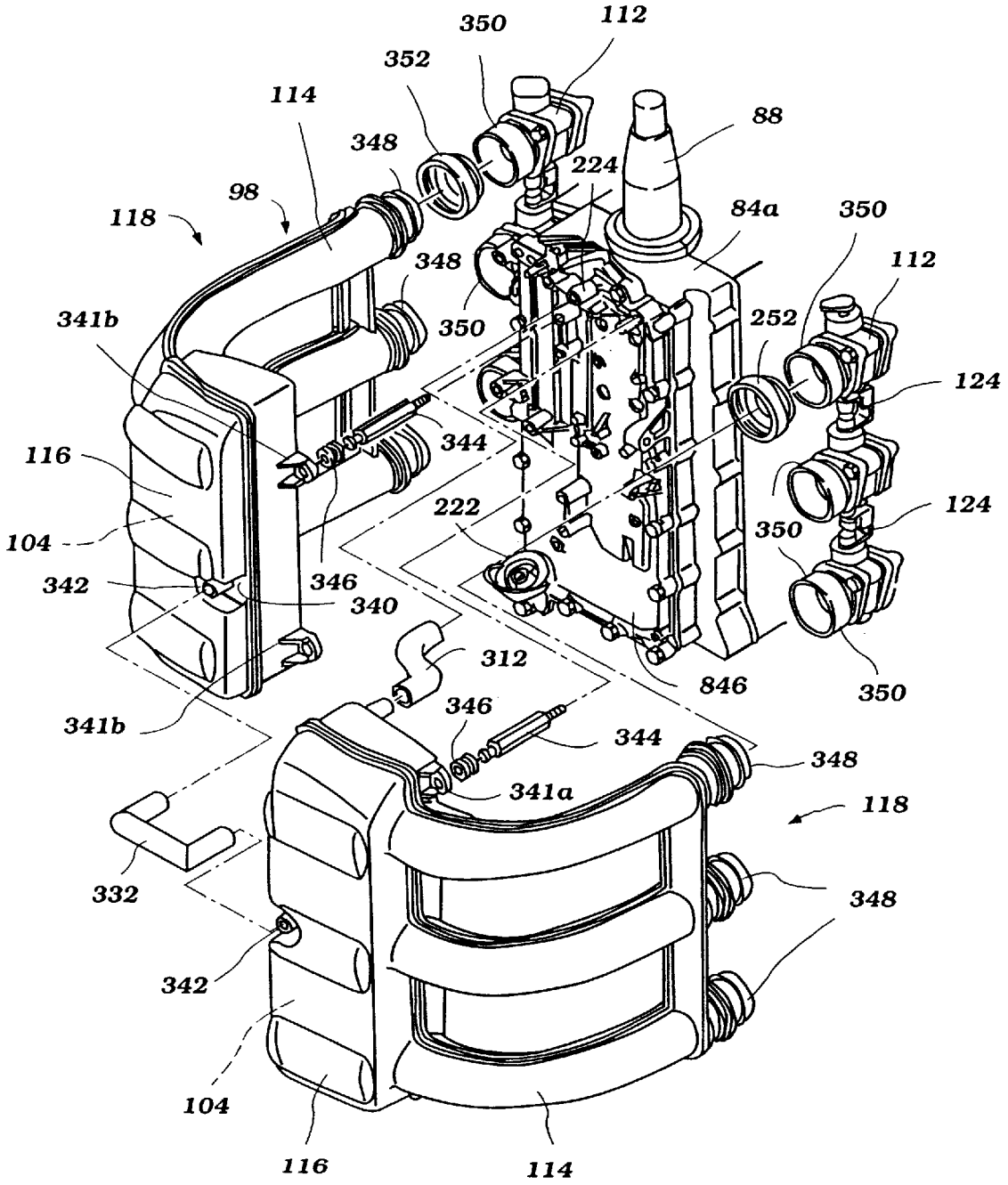
FIG. 7 is an exploded view of the engine including the crankcase member, the crankcase cover, the crankshaft and a major portion of the air induction system with the electrical components omitted.

The air intake passages 102 are defined by intake manifolds 110, throttle bodies 112 and intake runners 114. The plenum chambers 104 are defined by plenum chamber members 116. In the illustrated arrangement, the intake manifolds 110, the throttle bodies 112, the intake runners 114 and the plenum chamber members 116 together define air intake conduits. Each intake manifold 110 is affixed to the cylinder head member 80. As best seen in FIG. 7, in the illustrated arrangement, the intake runners 114 on each bank are unified with one of the plenum chamber members 116, which form a pair of intake units 118. The throttle bodies 112 are interposed between the intake manifolds 110 and the intake runners 114. The respective plenum chambers 104 are thus coupled to the associated intake ports 100 through the intake passages 102 defined in the intake runners 114, the throttle bodies 112 and the intake manifolds 110. Preferably, the intake manifolds 110 and the throttle bodies 112 are made of an aluminum alloy.

Figure 9:
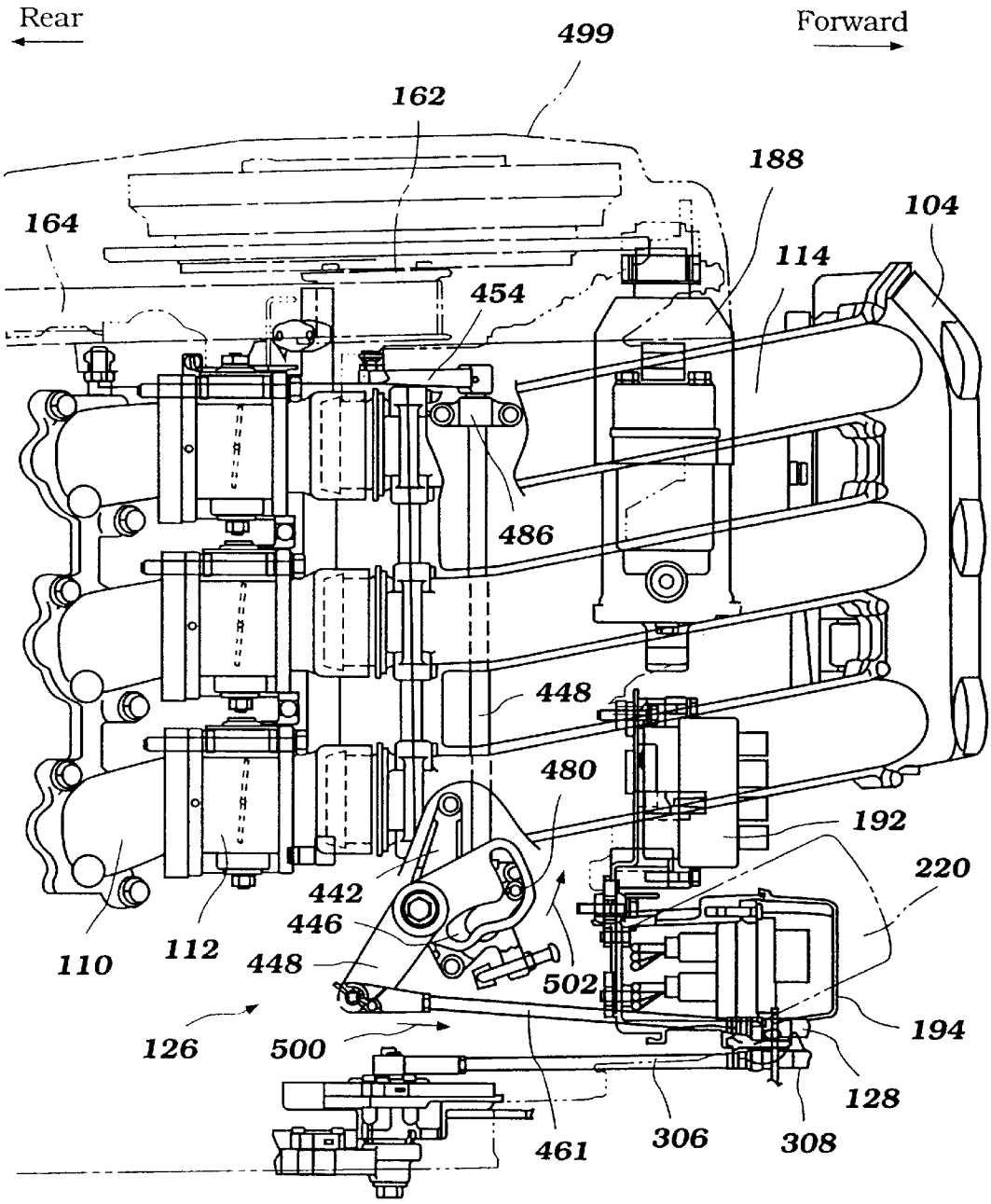
FIG. 9 is a schematic view of the starboard side of the engine.

With continued reference to FIGS. 3–4, the throttle bodies 112 support throttle valves 122. In the illustrated arrangement, the throttle valves 122 are butterfly valves that are disposed in the throttle bodies 112 for pivotal movement about the axis of valve shafts 124, which extend in a generally vertical direction. The valve shafts 124 are linked together to form a single valve shaft that passes through the entire throttle bodies 112 of each cylinder bank. The throttle valves 122 are operable by the operator through a throttle valve linkage 126 and a throttle cable 128 (FIG. 9). The throttle valves 122 control the amount of air flowing through the respective air intake passages 102. The throttle valve linkage 126 will be described in detail below.

The engine 32 also includes an exhaust system 136 for discharging exhaust gases outside of the outboard motor 30 from the combustion chambers 82. Specifically, because the illustrated engine 32 is a V-6 type, twelve exhaust ports 138 are provided, six of which are disposed at the bank on the starboard side, and another six of which are disposed at the bank on the port side. That is, each cylinder bore 76 preferably has two exhaust ports 138. The exhaust ports 138 preferably are defined in the respective cylinder head members 80 on the opposite sides of the respective banks relative to the intake ports 100 ( i.e., the inner sides of the cylinder banks). The exhaust ports 138 are opened and closed by exhaust valves 140. The respective banks have exhaust passages 141, which are defined by exhaust members 142. The exhaust members 142 extend in a generally vertical direction in parallel to each other in the space defined between the cylinder banks. The exhaust passages 141 communicate with the exhaust passage 72 of the exhaust guide member 68 (see FIG. 1).

Each cylinder bank has an intake camshaft 146 and an exhaust camshaft 148, which extend in a generally vertical direction. In the illustrated arrangement, both exhaust camshafts 148 are positioned next to each other because of the position of the intake and exhaust ports 100, 138. Correspondingly, the intake camshafts 146 are spaced apart from each other. The intake and exhaust camshafts 146, 148 extend within camshaft chambers 150, which are defined by the cylinder head members 80 and camshaft covers 152. The camshafts 146, 148 are journaled by the cylinder head members 80 and are rotatably affixed to the cylinder head member by camshaft caps 154. The intake camshafts 146 activate the intake valves 106, while the exhaust cam shafts 148 activate the exhaust valves 140. The respective camshafts 146, 148 have cam lobes 156 to open and close the intake and exhaust valves 106, 140, as is well known in the art. Accordingly, the illustrated engine utilizes a dual overhead cam shaft arrangement. However, it should be appreciated that the present invention can also be utilized with a single camshaft arrangement.

Figure 2:
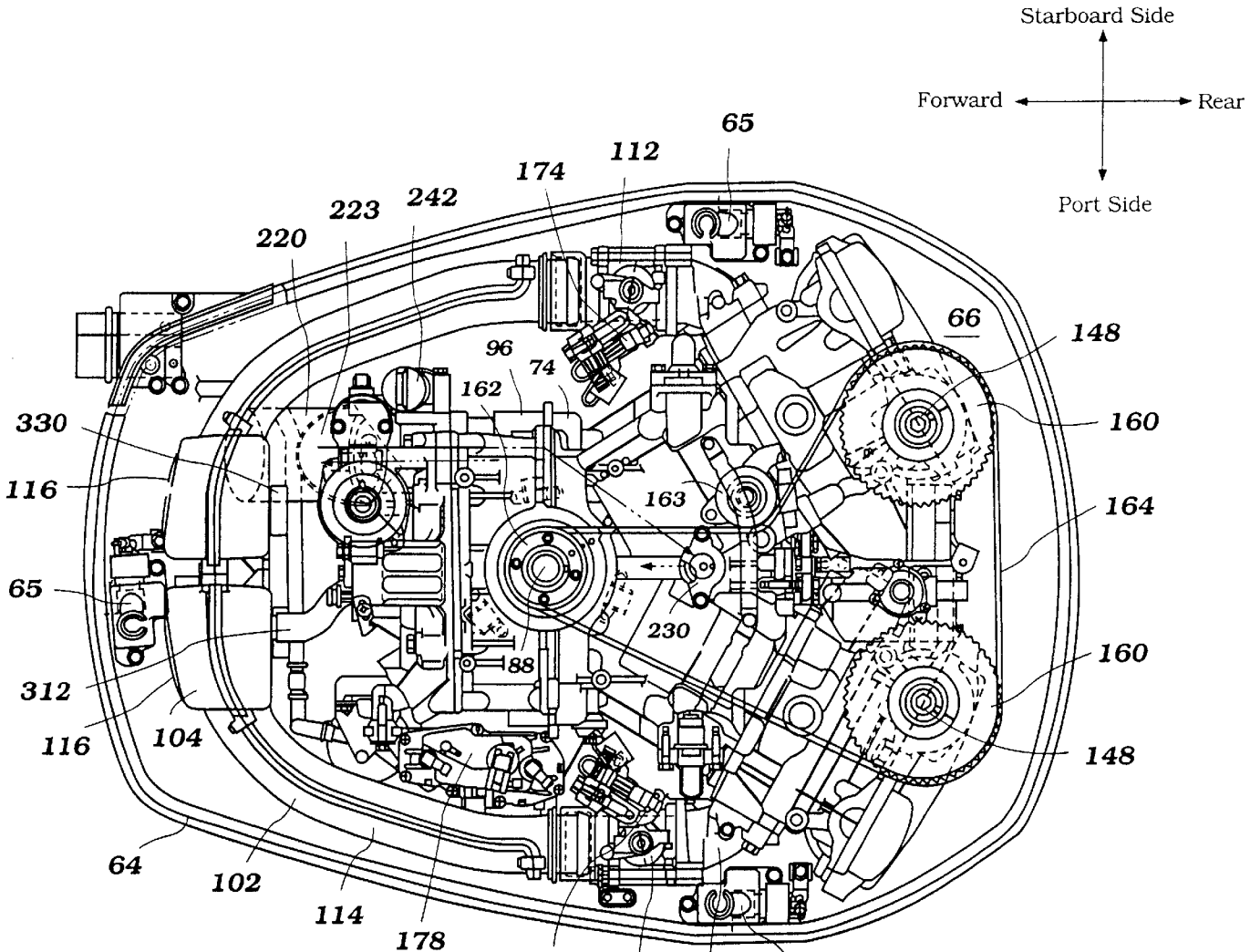
FIG. 2 is a top plan view of the engine of FIG. 1 with a throttle valve linkage omitted.
Figure 15:
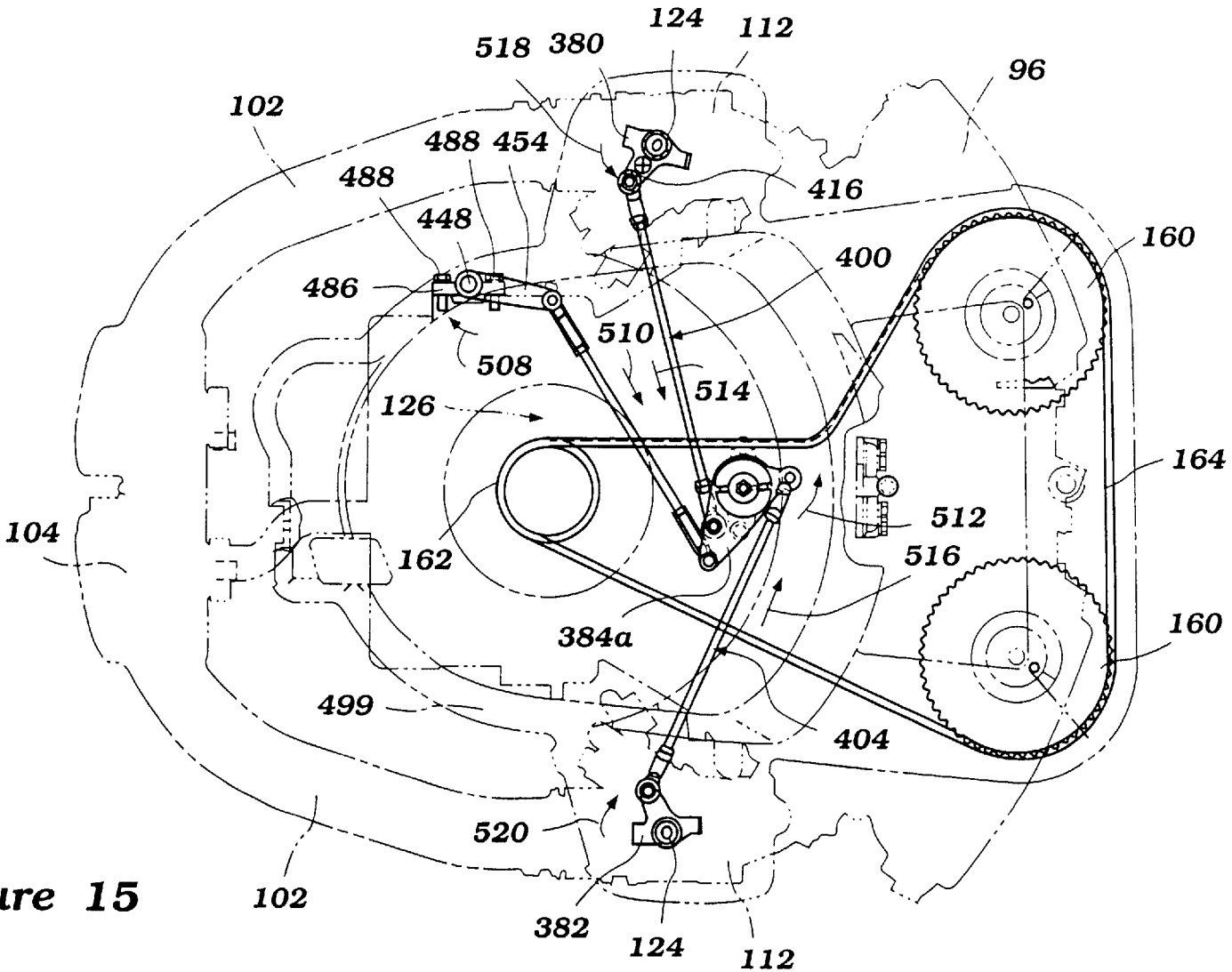
FIG. 15 is a top plan view of the throttle valve linkage with the engine shown in phantom.

As seen in FIGS. 2 and 15, exhaust camshafts 148 are driven by the crankshaft 88. Specifically, the exhaust camshafts 148 are fitted to driven sprockets 160, while the crankshaft 88 is fitted to a drive sprocket 162. A timing belt or chain 164 is wound around the drive and driven sprockets 162, 160. Accordingly, rotation of the crankshaft 88 causes the exhaust camshafts 148 also to rotate. A guide or idle roller 163 preferably is provided for pre-tensioning the timing belt 164

As seen in FIG. 3, the intake camshafts 146 are driven by the exhaust camshafts 148. Accordingly, The exhaust camshafts 148 are affixed to drive sprockets 165, while the intake camshafts 146 are affixed to driven sprockets 166. Timing belts or chains 168 are wound around the respective drive and driven sprockets 165, 166. Chain guide members 170 guide the belts 168. Thus, rotation of the exhaust camshafts 148 cause the intake camshafts 146 to rotate.

Preferably, the driven sprockets 160 of the exhaust camshafts 148 have a diameter that is twice as large as the diameters of the drive sprocket 162 of the crankshaft 88, the drive sprockets 165 of the exhaust camshafts 148 and the driven sprockets 166 of the intake camshafts 146. This causes the intake and exhaust camshafts 146, 148 to rotate at half the rotational speed of the crankshaft 88.

Figure 12:
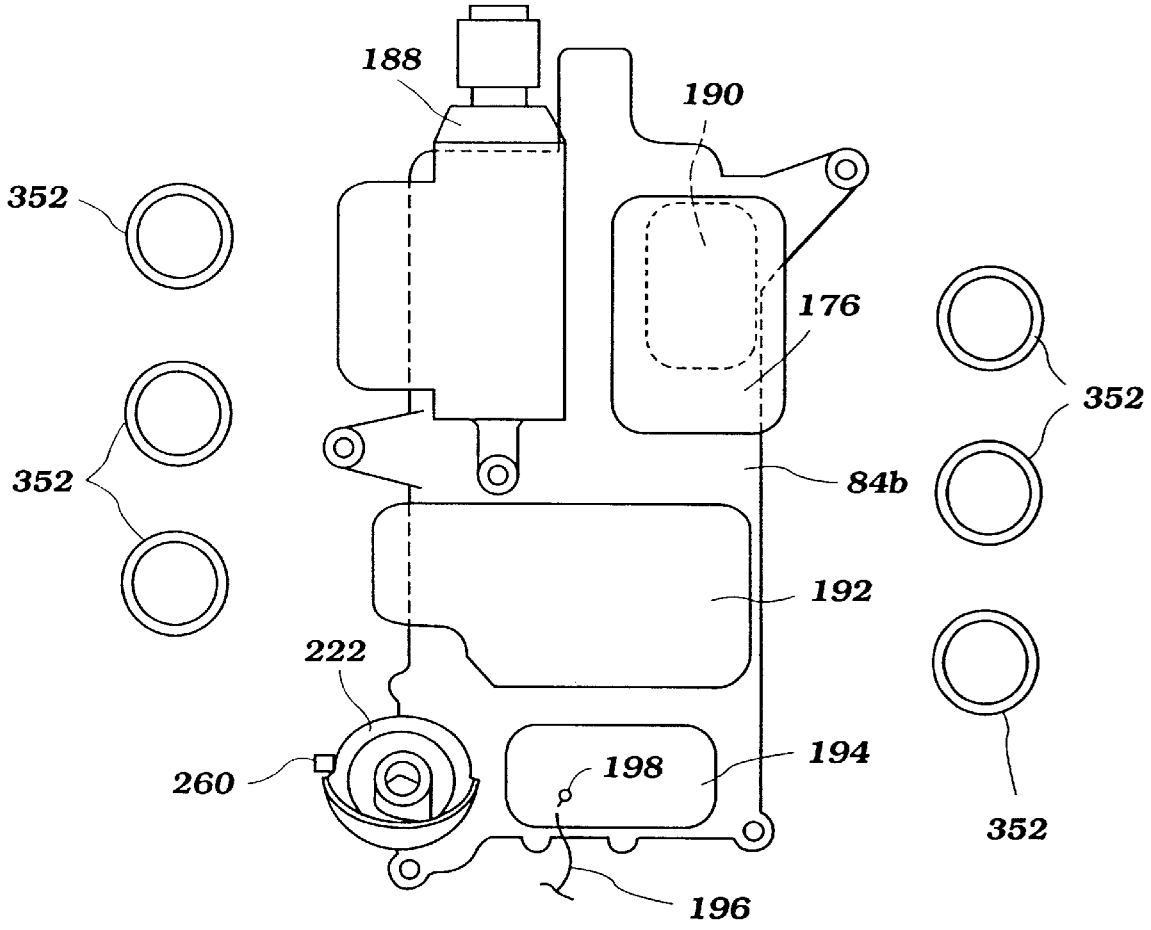
FIG. 12 is a schematic front view showing the arrangement of the crankcase cover, the intake passages and the electrical components.

With reference to FIGS. 2–4, the illustrated engine 32 includes a fuel injection system. However, it should be appreciated that the present invention can be utilized with other conventional fuel supply and charge forming systems such as carburetors can be applied. The illustrated fuel injection system includes six fuel injectors 174. Each fuel injector is associated with a combustion chamber 82. The fuel injectors 174 have injection nozzles directed toward the respective intake passages 102 adjacent to the intake ports 100. The fuel injectors 174 spray fuel into the intake passages 102 and are controlled by an ECU (Electronic Control Unit) 176 (FIG. 12). As is well known in the art, the ECU 176 is configured to controls the amount of fuel injected into the intake passage and a timing of such fuel injection. The fuel injectors 174 are supported by fuel rails, which affixed to the throttle bodies 112.

The fuel injection system also includes a fuel supply tank (not shown) that is placed in the hull of the associated watercraft 42. A low-pressure fuel pump draws fuel from the fuel tank through a fuel supply passage by to a fuel reservoir or fuel vapor separator 178. Preferably, the vapor separator 178 is generally disposed in a space S1 (see FIG. 3) defined between intake runners 114 and the engine body 96. More preferably, the vapor separator 178 is located between the port side surface of the crankcase assembly 84 and the intake runners 114. Advantageously, in this arrangement, the intake runners 114 protect the vapor separator 178 from the coupling mechanism 65 when the upper cowling is separated from the lower cowling. That is, the intake runners 114 protect vapor separator 178 and the fuel lines (not shown) connected to the vapor separator 178 from the coupling mechanism as the upper cowling is separated from the lower cowling.

The vapor separator 178 preferably includes a float valve (not shown) to maintain a uniform level of the fuel in the vapor separator 178. The vapor separator 178 also preferably includes a high-pressure fuel pump (not shown) that delivers high pressure fuel to the fuel injectors 174 through a fuel delivery passage, which includes the fuel rail. Preferably, the high-pressure fuel pump is an electric pump that is driven by an electric motor.

A fuel return passage connects a portion of the fuel delivery passage to the vapor separator 178. A pressure regulator is positioned in the return passage and limits the pressure that is delivered to the fuel injectors 174 to a preset pressure by dumping some of the fuel back to the vapor separator 178. Accordingly, the pressure regulator keeps the fuel pressure near constant value. The ECU 176 thus controls the amount of fuel injected into the combustion chamber by controlling the duration that each injector is open.

The engine 32 also includes a suitable ignition or firing system. In the illustrated arrangement, three spark plugs 180 are mounted on each cylinder head member 80 with their electrodes exposed to the associated combustion chambers 82. The spark plugs 180 ignite an air/fuel charge is well known in the art. The ECU 176 through a firing system controls the timing of the spark plugs 180. As seen in FIG. 1, a flywheel assembly 184 is affixed to the crankshaft 88. The flywheel assembly 184 includes a generator to supply electric power to the firing system, to the ECU 176 and to other electrical components via a battery 186 and/or directly. The battery 186 preferably is disposed in the hull of the watercraft 42.

As seen in FIGS. 3, 9,12 and 21, the electrical components of the engine also include a starter motor 188, a rectifier regulator 190, a relay box 192, which contains various relay elements 192*a*, and a fuse box 194, which contains various fuses 194*a*. The starter motor 188 drives the crankshaft 88 when the engine 32 is being started and the rectifier regulator 190 converts AC current to DC current. A flywheel cover 499 (see FIG. 9) is positioned generally above the fly wheel.

With particular reference to FIGS. 3 and 12, certain electrical components, the ECU 176, the starter motor 188, the rectifier regulator 190, the relay box 192, and the fuse box 194, preferably are disposed in a space S2 defined between the intake runners 114, the plenum chamber members 116, and the engine body 96. More preferably, these electrical components 176, 188, 190, 192, 194 are interposed between the crankcase cover 84*b* and the plenum chamber members 116. Most preferably, these electrical components are also located substantially beneath the flywheel cover 499 (see FIG. 9). It is also preferable that these electrical components 176, 188, 190, 192, 194 are supported by the crankcase cover 84*b*. For example, in the illustrated arrangement, the ECU 176, the starter motor 188 and the rectifier regulator 190 are positioned at an upper portion of the crankcase cover 84*b*. The ECU 176 and the rectifier regulator 190 are placed in parallel to the starter motor 188, and the regulator 190 is in a behind the ECU 176. The relay box 192 is positioned at a middle portion of the crankcase cover 84*b* and the fuse box 194 is positioned under the relay box 192. This arrangement is advantageous because it uses the space between the crankcase assembly 84 and the plenum chamber members 116, which reduces the size of the outboard motor 30. Moreover, in this arrangement, the plenum chamber members 116 and the intake runners 114 protect the electrical components 188, 190, 192, 194 from the coupling mechanism 65 when the top cowling member 62 is detached. Several features and advantages of the present invention can be achieved with less than all of these electrical components 176 188, 190, 192, 194 positioned as described above. However, this arrangement described above is preferred because it efficiently protects these electrical components from damage caused by the coupling mechanism as described above.

Figure 21:
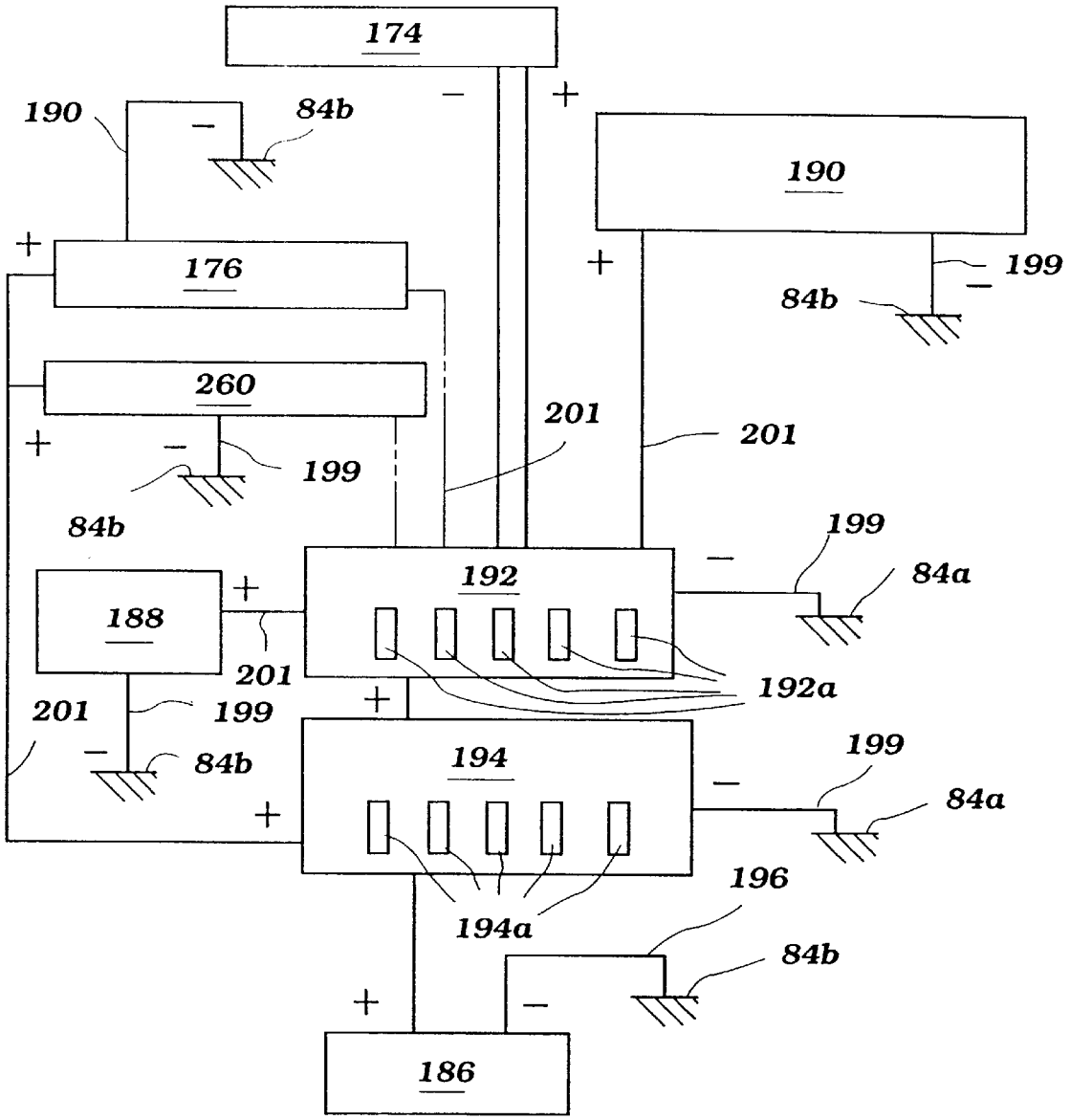
FIG. 21 is a schematic illustration showing a wiring outline of the electrical components of the engine.

As seen in FIGS. 1,12 and 21, the battery 186 preferably is grounded to the crankcase cover 84*b*. That is, a ground line 196 of the battery 186 is connected to a portion 198 of the crankcase cover 84*b*. The electrical components 176, 188, 190, 192, 194 preferably also are grounded to the crankcase cover 84*b* by grounding lines 199. With particular reference to FIG. 21, the electrical components 176, 188, 190, 192, 194 are connected together by a set of wires 201. In the illustrated arrangement, the set of wires 201 preferably are also located in the space S2 defined between the intake runners, the plenum members 116 and the engine body 96 such that the intake runners 114 and the plenum members 116 prevent the wires from being contacted by the coupling mechanism 65 when the upper cowing member 62 is detached.

With reference to FIG. 1, the engine 32 also includes a lubrication system. In the illustrated arrangement, the lubrication system includes a lubricant reservoir 200 that depends from the exhaust guide member 68 into the driveshaft housing 56. The lubricant reservoir 200 preferably has a doughnut-type shape. A suction pipe 202 is provided in the lubricant reservoir 200 to connect the reservoir 200 to an pump unit 204. An oil strainer 206 is provided at the entrance to the suction pipe 202 for removing alien substances from the lubricant.

The crankshaft 88 drives the pump unit 204 of the lubrication system. The pump unit 204 draws lubricant from the lubricant reservoir 200 and delivers it to portions of the engine that need lubrication as is well known in the art. Preferably, the pump unit 204 is disposed at the bottom of the engine 32 as sown in FIG. 1. As best seen in FIG. 5, the pump unit 204 has an inlet port 210 and an outlet port 212. The inlet port 210 communicates with the suction pipe 202 through a suction passage 214, while the outlet port 212 communicates with the engine portions through a delivery passage 216. The suction passage 214 is defined by the exhaust guide member 68 and the cylinder block 74, while the delivery passage 216 is defined by the cylinder block 74.

Figure 6:
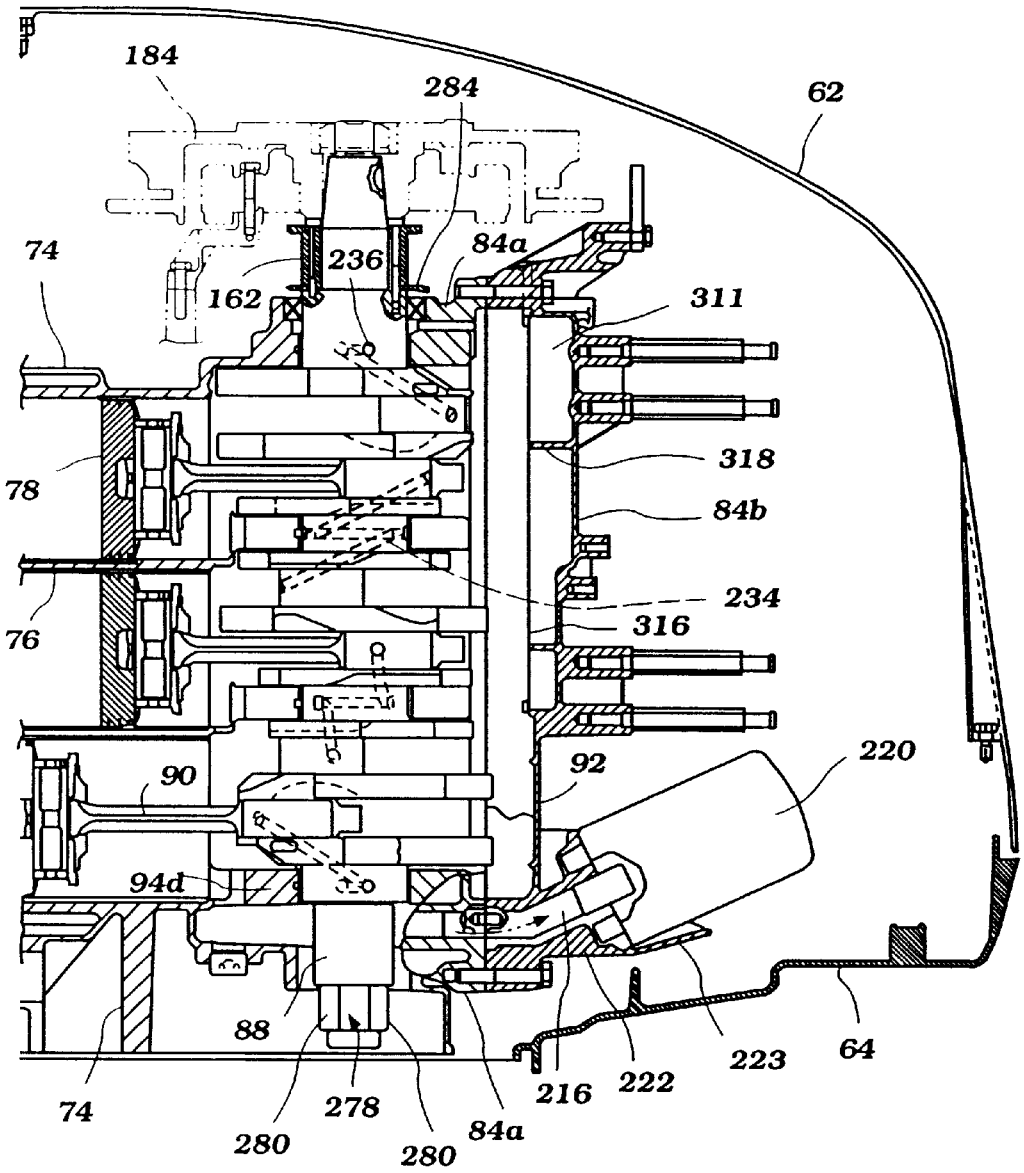
FIG. 6 is a sectional side view of a portion of the engine generally taken along a vertical plane extending through cylinder bores on one bank with the oil pump unit and the baffle plate omitted.

Portions of the engine 32 that need lubrication include, for example, crankshaft bearing portions 218 where the bearing blocks 94*a*, 94*b*, 94*c*, 94*d* support the crankshaft 88. As best seen in FIGS. 6 and 11, an oil filter 220 is detachably affixed to a mount projection 222 formed at a bottom portion of the crankcase cover 84*b* to remove alien substances from the lubricant. The mount projection 222 has a guide portion 223 that can temporarily support and guide the body of the oil filter 220 when the filter 220 is attached to the mount projection 222. As best seen in FIG. 6, the oil filter 220 is obliquely mounted onto the mount projection 222. Accordingly, the oil filter 220 is positioned at the bottom portion of the crankcase cover 84*b*, it can be easily put to or removed from the mount projection 222.

The delivery passage 216 communicates with the oil filter 220. The oil filter 220, in turn, communicates with a supply passage 224 (FIG. 5) and then with a main gallery 226 (FIGS. 3, 4, 11 and 14). A closure member 230 closes the top portion of the main gallery 226. The lubricant is then supplied to the respective bearing portions through branch passages defined within the bearing blocks 94*a*, 94*b*, 94*c*, 94*d*. After the lubrication, the lubricant drops to the bottom of the crankcase chamber 86 due to its own weight.

Other portions of the engine 32 that need lubrication include where the connecting rods 90 are coupled with the crankshaft 88 and where they are coupled with the pistons 78. Some of the lubricant is delivered to these portions through drilled passages 234 in the crankshaft 88 and the connecting rods 90 with inlet ports 236 opened at certain portions of the crankshaft 88. After lubricating these portions, the lubricant falls to the crankcase chamber 86.

One or more through-holes are made at each skirt portion of the piston 78 such that the lubricant can move to the outer surface of the piston 78 which slides along the surface of the cylinder bore 76. Piston rings are provided on the pistons 78 primarily to isolate the combustion chambers 82 from the crankcase chamber 86. At least one piston ring, which is normally placed at the lowermost position, can remove the lubricant from the surface of the cylinder bore 76 to the crankcase chamber 86. The camshaft bearing portions is preferably also lubricated with lubricant delivery arrangements for the camshaft bearing portions similar to the arrangements described above. The lubricant that has dropped to the crankcase chamber 86 returns to the lubricant reservoir 200 through a return passage and is recycled.

Figure 13:
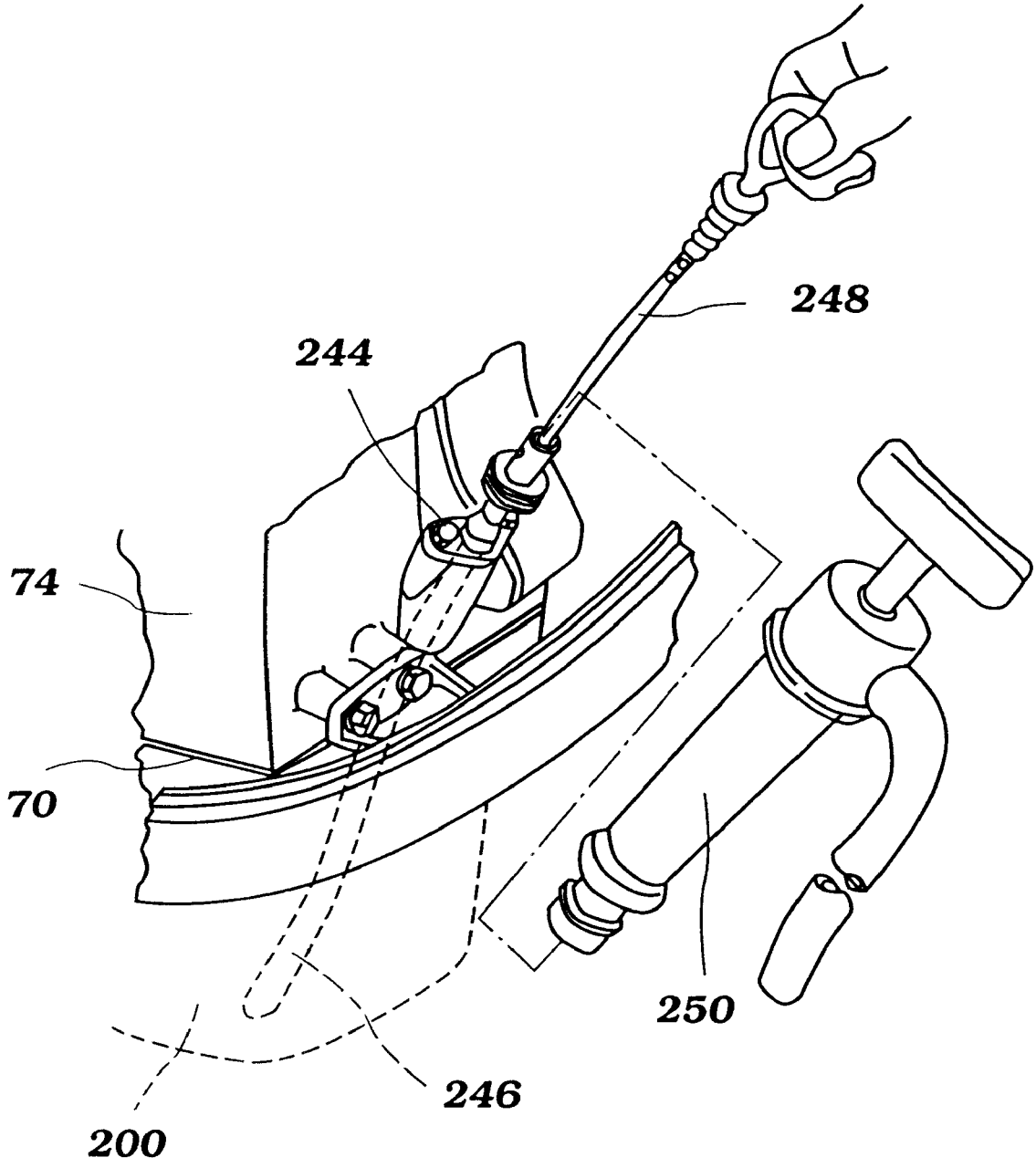
FIG. 13 is a perspective side view showing a portion of the cylinder block where an lubricant dipstick is positioned.

As best seen in FIG. 11, the lubrication system has a lubricant replenishment pipe 240 affixed to a side surface of the crankcase cover 84*b*. A cap 242 closes an inlet port atop the pipe 240. The illustrated lubrication system further has a level gauge unit 244 comprising a guide pipe 246 and an lubricant dipstick 248. As best seen in FIG. 13, the guide pipe 246 passes through an opening formed at a bottom portion of the cylinder block 74 and its top portion is detachably affixed to the portion of the cylinder block 74 by a bolt 249. The lowermost portion of the guide pipe 246 reaches near to the bottom of the lubricant reservoir 200. The dipstick 248 is normally inserted into the guide pipe 246. The operator or user of the outboard motor 30 can take the dipstick 248 out of the guide pipe 246 to check an amount of the lubricant and/or a condition of the lubricant. If the operator replaces the dipstick 248 with a lubricant remover pump 250 the lubricant in the reservoir 200 can be removed through the guide pipe 246.

The engine 32 preferably also includes a cooling system for cooling certain portions of the engine 32, such as, for example, the cylinder block 74 and the cylinder head member 80. Accordingly, in the illustrated arrangement, coolant jackets 256 (FIG. 4) are formed within the cylinder block 74 and the cylinder head member 80. The coolant preferably is also supplied to the exhaust system 136. As best seen in FIG. 3, cover members 258 are affixed to the exhaust members 142 to define the water jackets 256. Preferably, the coolant is water that introduced from the body of water surrounding the outboard motor 30 in a manner that is well known in the art.

The engine 32 preferably also includes several sensors, which along with the ECU 176 form the engine control system. For example, an oil pressure sensor 260 (FIGS. 12 and 21) senses the lubricant pressure of the lubrication system. More specifically, if the oil pressure at, for example, the delivery passage 216 drops down below a preset value, the pressure sensor 260 outputs a signal so that the ECU 176 recognizes this abnormal situation. A crankshaft angle position sensor 262 (FIG. 5) is provided atop the cylinder block 74 in the close proximity to a washer 264 that is affixed to the crankshaft 88. The washer 264 has notches around its outer periphery. The position sensor 262 generates signals as the notches pass the sensor 262. These signals are used by the ECU 176 to determine engine speed as is well known in the art. Of course, those of skill in the art will recognize that the engine control system can include other sensors.

With reference back to FIG. 1, the driveshaft housing 56 depends from the power head 54 and supports a driveshaft 270 which is driven by the crankshaft 88. The crankshaft 88 has a splined recess 271 (FIG. 5) at its bottom portion, while the driveshaft 270 has a splined top. The splined top of the driveshaft 270 is fitted into the splined recess 271 of the crankshaft 88 so that the driveshaft 270 is coupled to the crankshaft 88. The driveshaft 270 extends generally vertically through the exhaust guide member 68 and then extends through the driveshaft housing 56 in front of the lubricant reservoir 200.

The driveshaft housing 56 also defines internal passages, which form portions of the exhaust system 136. For example, in the illustrated arrangement, an exhaust pipe 272 depends from the exhaust guide member 68 and extends downwardly through the center hollow of the lubricant reservoir 200. An upper portion of the exhaust pipe 272 communicates with the exhaust passage 72, which is defined by the exhaust guide member 68. An exhaust expansion chamber (not shown) depends from a bottom of the lubricant reservoir 200. A lower portion of the exhaust pipe 272 communicates with the expansion chamber. The expansion chamber has a relatively large capacity so that the exhaust gases can expand thereby reducing exhaust noise. An idle exhaust passage (not shown) is branched off from one of the internal passages and opens to the atmosphere above the body of water.

With reference to FIGS. 1, 5 and 6, the construction of the illustrated pump unit 204 will now be described in more detail. As described above, the pump unit 204 is positioned at the bottom portion of the cylinder block 74 and the crankcase member 84*a* where the driveshaft 270 is coupled with the crankshaft 88. In the illustrated arrangement, the pump unit 204 is a rotary or trochoid pump. This type of pump, however, is merely exemplary of a type that can be used for the lubrication system. Other types of pumps such as, for example, a gear pump, can also be used.

An upper housing member 273 is affixed to the bottom of the cylinder block 74 and the crankcase member 84*a* by bolts 274. The upper housing member 272 has a cylindrical portion 275 fitted into a recessed portion defined by the cylinder block 74 and the crankcase member 84*a*. The cylindrical portion 275 defines an opening through which the crankshaft 88 extends. An upper lubricant seal member 276 is provided between an outer surface of the crankshaft 88 and an inner surface of the upper housing member 272 for preventing the lubricant in the pump unit 204 from leaking out. As mentioned above, the inlet port 210 and the outlet port 212 are formed at the upper housing member 272. The upper housing member 272 can be made of metal or plastic.

As seen in FIG. 6, the lower portion of the crankshaft 88 preferably includes two flat surfaces 278 that extend in parallel to each other. The lower portion of the crankshaft also includes arced surfaces 280. As seen in FIG. 5, an inner rotor 282, which has a recess that is configured to mate with the lower portion of the crankshaft 88, is fixed to the crankshaft 88 by a drive collar or bush member 284. An outer rotor 286 meshes with the inner rotor 282. The inner and outer rotors 282, 286 form a pumping assembly. It should be appreciated that the inner rotor 282 can be directly coupled with the crankshaft 88 thereby eliminating the drive collar 284. 0

A lower housing member 288 is affixed to the lower surface of the upper housing member 272 and defines a pump cavity with the upper housing member 272 in which the inner and outer rotors 282, 286 are disposed. In the illustrated arrangement, the lower housing member 288 is defined by a single piece. The lower housing member 288 has an opening through which both the crankshaft 88 and the driveshaft 270 extend. The bolts 274 are used in this arrangement for fixing the lower housing member 288. An inlet passage 290 and an outlet passage 292 are defined between the upper housing member 272 and the lower housing member 288. The inlet passage 290 communicates with the inlet port 210, while the outlet passage 292 communicates with the outlet port 212. The lower housing member 288 can be made of metal or plastic.

In the illustrated arrangement, a lower lubricant seal member 294 is provided between the crankshaft 88 and an inner surface of the lower housing member 288. A water seal member 296 is provided between a surface of the driveshaft 270 and the lower housing member 288. The lower lubricant seal member 294 inhibits the lubricant in the pump unit 204 from leaking out from the oil pump unit 214, while the water seal member 296 inhibits water or water mist from entering around the coupling portion. The lower oil seal member 294 inhibits the lubricant in the housing members 272, 288 from leaking. Thus, lubricant does not accumulate at the coupling portion of the driveshaft 270. This prevents damage to the drive shaft.

Rotation of the crankshaft 88 drives the inner rotor 282 through the drive collar 284. Because the outer rotor 286 meshes with the inner rotor 282, the outer rotor 286 also rotates with the inner rotor 282. A space, which is defined between the inner and outer rotors 282, 286, communicates with the inlet passage 290 and the outlet passage 292, and changes their volume with the rotation of the inner and outer rotors 282, 286. The lubricant in the space is thus suctioned from the inlet passage 290 and pushed to the outlet passage 292.

In addition, the lower oil seal member 294 directly faces the outer surface of the crankshaft 88 and thus does not require an additional sleeve. This outer surface of the crankshaft 88 can be simultaneously machined with other portions of the crankshaft 88. The construction does not require the manufacturing step that has been necessary for the conventional construction accordingly.

With reference back to FIG. 1, the lower unit 58 depends from the driveshaft housing 56 and supports a propulsion shaft 300 that is driven by the driveshaft 270. The propulsion shaft 300 extends generally horizontally through the lower unit 58. In the illustrated arrangement, the propulsion device supports a propeller 302 that is affixed to an outer end of the propulsion shaft 300. It should be appreciated that the propulsion device can take the form of a dual, a counter-rotating system, a hydrodynamic jet, or like propulsion devices.

A transmission 304 is provided between the driveshaft 270 and the propulsion shaft 300. The transmission 304 couples together the two shafts 270, 300 which lie generally normal to each other (i.e., at a 90° shaft angle) with a bevel gear train or the like as is well known in the art. The transmission 304 has a switchover or clutch mechanism (not shown) to shift rotational directions of the propeller 302 to forward, neutral or reverse. The switchover mechanism is operable by the operator through a shift linkage (not shown) including a shift cam, a shift rod, a coupling rod 306 and a shift cable 308 (FIG. 9). The shift cable 308 extends toward the watercraft 42 along with the throttle cable 128.

The lower unit 58 also defines an internal passage (not shown) that forms a discharge section of the exhaust system 136. An upper portion of this internal passage connects to the expansion chamber in the driveshaft housing 56. At engine speed above idle, the majority of the exhaust gases are discharged toward the body of water through the internal passage and a hub of the propeller 302. At the idle speed of the engine 32, the exhaust gases can be discharged only through the idle exhaust passage because the exhaust pressure under this condition is less than the backpressure created by the body of water.

With reference to FIGS. 3, 4, 10 and 11, the crankcase assembly 84 and the crankcase chamber 86 will now be described in greater detail. In the illustrated arrangement, a baffle plate 310 is affixed to the crankcase member 84*a* to divide the crankcase chamber 86 into a primary chamber 86*a* and a secondary chamber 86*b* (FIG. 3). Both chambers 86*a*, 86*b* communicate with each other through a plurality of slits or through-holes 312 (FIG. 11) and spaces defined at both sides of the baffle plate 310. The primary chamber 86*a* has a larger capacity than the secondary chamber 86*b* and the crankshaft 88 exists in the primary chamber 86*a*. As seen in FIG. 3, the baffle plate 310 bulges towards the secondary chamber 86*b*.

After the lubrication of the respective engines, the lubricant hangs in the primary chamber 86*a* as a mist or vapor. This lubricant mist drops down to the lubricant reservoir 200 because of the rotation of the crankshaft 88 in the primary chamber 86*a*. The baffle plate 310 advantageously helps to return the lubricant quickly to the reservoir 200. Specifically, the lubricant mist can move to the secondary chamber 86*b* through the slits 312 in the plate 310 and spaces defined at both sides thereof. Once it has moved to the secondary chamber 86*b*, the mist condenses back to a liquid state by adhering to the surface of the baffle plate 310 and an inner surface of the crankcase cover 84*b* because the rotational movement of the crankshaft 88 does not influence the mist in the secondary chamber 86*b*. The liquid lubricant flows to the lubricant reservoir 200 along the surfaces of the baffle plate 310 and the crankcase cover 84*b*. The baffle plate 310 is also useful for preventing the lubricant from splashing onto the crankshaft 88 during a replenishment of the lubricant because crankshaft 88 is positioned in the primary chamber 86*a* that is separated from the secondary chamber 86*b* into which the lubricant is introduced through the lubricant replenishment pipe 240.

The lubricant mist in the primary chamber 86*a* also includes blow-by gases. The blow-by gases comprise unburnt charges and a small amount of exhaust gases that have moved from the combustion chambers 82. Although the combustion chambers 82 are isolated by the piston rings as noted above, those gases can leak to the crankcase chamber 86 because of huge expansion pressure generated in the combustion chambers 82. In order to remove the blow-by gases and oil vapors that remain still in the secondary chamber 86*b*, a ventilation system is provided in the engine 32, of this arrangement. The ventilation system comprises a breather chamber or oil separator 311 and a breather pipe 312 (see FIG. 4).

Figure 10:
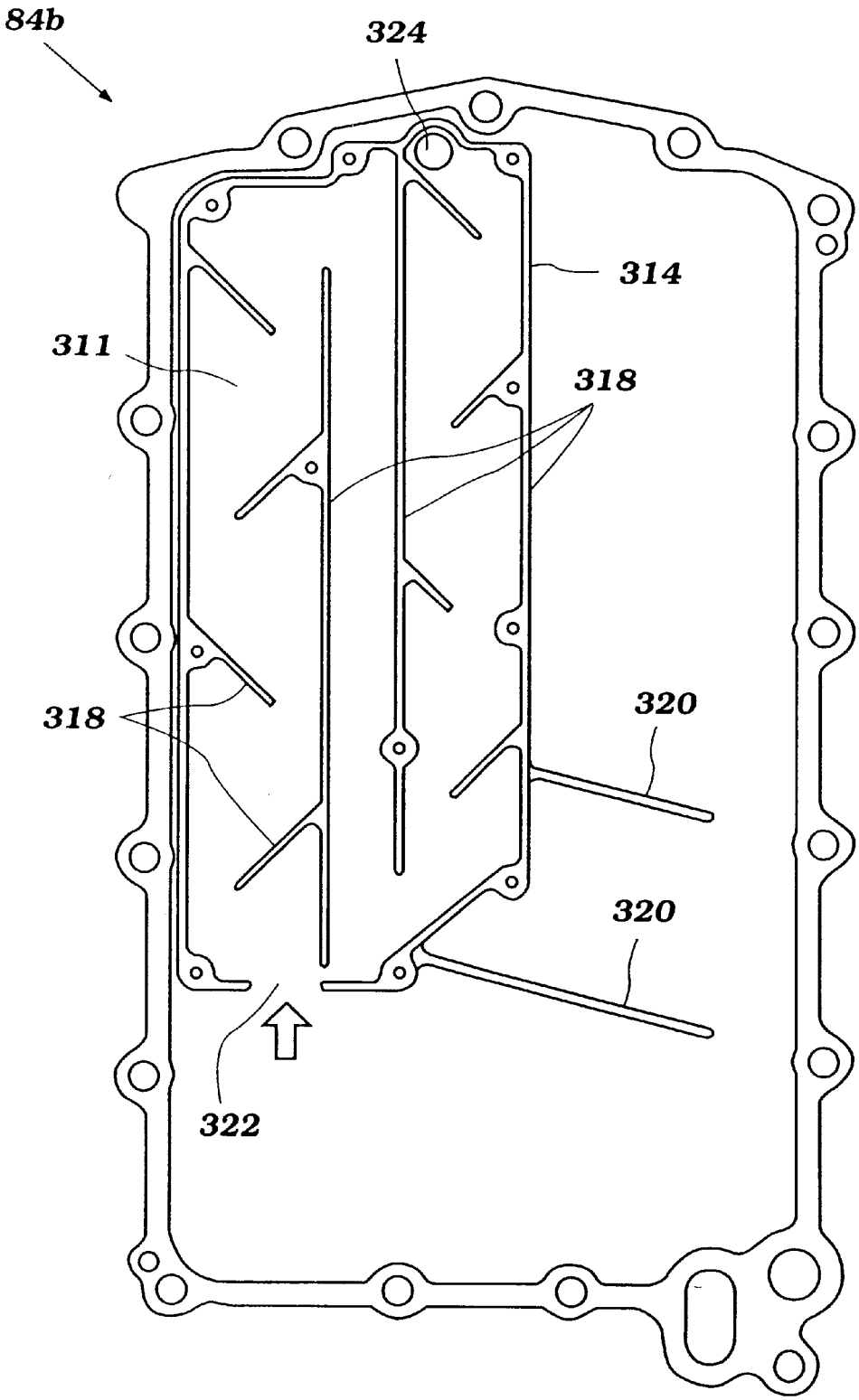
FIG. 10 is a rear elevational view of the crankcase cover.

As best seen in FIGS. 6 and 10, the breather chamber 311 is defined by an inner surface of the crankcase cover 84*b*, a rampart 314 extending from the inner surface of the crankcase cover 84*b* and a lid plate 316 affixed to the rampart 314. A plurality of baffle projections 318 also extends from the inner surface of the crankcase cover 84*b* so that a labyrinth structure is formed within the breather chamber 311. The baffle projections 318 are generally directed downwardly. Additionally, other baffle projections 320 are provided out of the breather chamber 311 in the same manner.

An inlet port 322 of the breather chamber 311 opens downwardly at its bottom portion, while an outlet port 324 thereof, which is a through-hole, opens atop the breather chamber 311 and also atop of the crankcase cover 84*b*.

As best seen in FIG. 4, the breather pipe 312 couples the breather chamber 311 with one or both of the plenum chambers 104. In the illustrated arrangement, the plenum chamber member 116 which is disposed on the port side has an inlet port 326, and the breather pipe 312 connects the outlet port 324 of the breather chamber 311 to the inlet port 326 of this plenum chamber member 116.

The lubricant vapors or mist including the blow-by gases are introduced into the breather chamber 311 through the inlet port 322 because the air in the plenum chamber 104 is drawn to the combustion chambers 82 during engine operations to depressurize the breather chamber 311. The baffle projections 320 formed out of the breather chamber 311 inhibits the lubricant vapors from going to other portions in the crankcase cover 84 than the breather chamber 311. The lubricant vapors introduced into the breather chamber 311 are directed to the outlet port 324 through the labyrinth structure. Because the baffle projections 318 prevent the lubricant vapors from moving smoothly, the vapors return back to the liquid state and thus are separated from gases. The liquid lubricant then drops down to the lubricant reservoir 200 and only the gases still go to the outlet port 324. The gases then move to the plenum chamber 104 through the breather pipe 312 and further to the combustion chambers 82 through the intake passages 102. The gases that have reached the combustion chambers 82 are burned therein with the air/fuel charges that have been simultaneously supplied to the combustion chambers 82. Because the breather chamber 311 is positioned in the close proximity to the plenum chamber 104 in this arrangement, the length of the breather pipe 312 is reduced.

With reference to FIGS. 1 to 4, 7 and 9, the air induction system 98, particularly the plenum chamber members 116, will now be described in greater detail below. In the illustrated arrangement, both the plenum chamber members 116 are generally disposed on an opposite side of the crankshaft 88 relative to the crankcase assembly 84. The plenum chamber members 116 are positioned in close vicinity to each other. The engine 32 has a center line C (FIG. 4) extending through both the cylinder block 74 and the crankcase assembly 84. The plenum chamber members 116 are spaced apart from each other so as to exist on both sides of the center line C. As best seen in FIG. 4, the crankcase assembly 84 in this arrangement has a surface extending generally normal to the center line C. Both the plenum chamber members 116 preferably face to the surface. Moreover, the throttle bodies 112 have axes that preferably extend generally parallel to the center line C. Portions of the intake runners 114 preferably also extend generally parallel to the center line C.

The plenum chamber members 116 have air inlet ports 330 opening toward the crankcase assembly 84 and an axis of each inlet port 330 extends generally parallel to the centerline. That is, the air inlet ports 330 preferably face to the electrical components 176, 188, 190 192, 194 placed between the crankcase assembly 84 and the plenum chamber members 116. The air in the closed cavity 61 of the cowling assembly 60 is introduced into the plenum chambers 104 through the inlet ports 330 without interfering with each other. Before entering, the air flows around the electrical components 176, 188, 190 192, 194, thereby cooling the electrical components 176, 188, 190 192, 194.

As best seen in FIGS. 4 and 7, a balance pipe 332 couples both of the plenum chambers 104 together. The balance pipe 332 is a simple and relatively small pipe to balance or equalize the air intake pressure at the respective plenum chambers 104. The pipe 332 is generally configured as a U-shape and has a passage portion 334 and a pair of connecting portions 336. Each plenum chamber member 116 has a recess 340 at its forward portion. The recesses 340 of the respective plenum chamber members 116 are generally sequentially formed with each other. A hollow coupling projection 342 extends from each of the plenum chamber member 116 at the recess 340. The connecting portions 336 are fitted into the respective coupling projections 342 to complete the communication of the plenum chambers 104 with each other. When the connecting portions 336 are coupled with the projections 342, outer forward surfaces of the plenum chamber members 116 and an outer surface of the pipe 332 together define an even surface. That is, the pipe 332 is generally completely fitted in the recesses 340 and does not project from the forward surface of the plenum chamber members.

Figure 8:
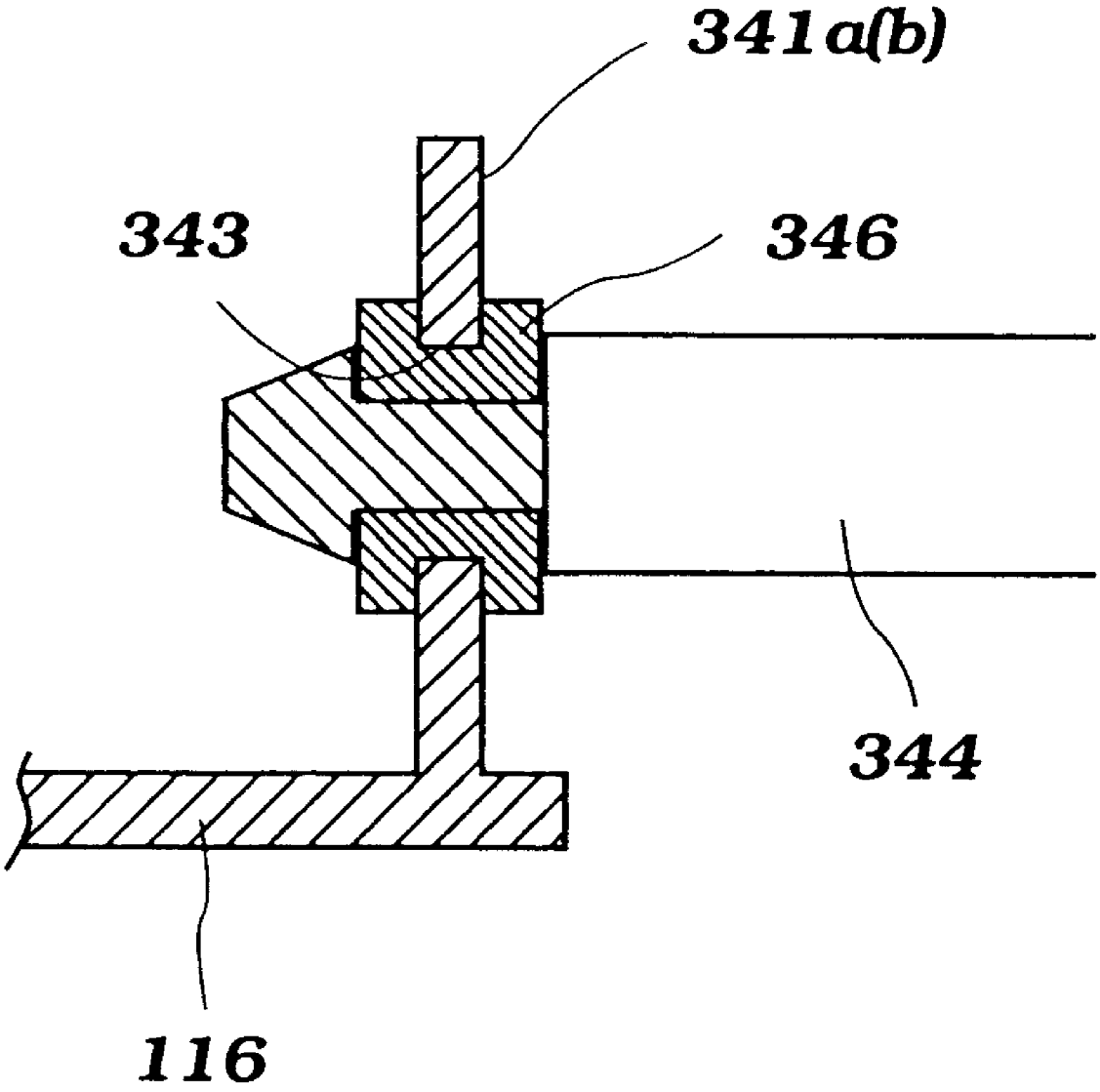
FIG. 8 is a sectional view of a one-touch fastener including a rod member and a grommet.

With primary reference to FIGS. 4, 7 and 8, a mounting arrangement of the intake units 118 will now be described. The plenum chamber member 116 of the intake units 118 disposed on the port side has a pair of projections 341*a* extending transversely toward the opposite side of the other intake unit 118 on the starboard side and spaced apart vertically from each other. The projections 341*a* define through-holes 343 (FIG. 8). The plenum chamber member 116 on the starboard side, in turn, has also a pair of projections 341*b* extending transversely toward the other intake unit 118 on the port side and spaced apart vertically from each other. Four rod members 344, each of which has a hexagonal shape are screwed into the crankcase cover 84*b* at appropriate locations to secure the intake units 118. An axis of each rod member 344, when it is screwed down to the crankcase cover 84*b*, extends generally in parallel to the center line C. As best seen in FIG. 8, a tip portion of each rod member 344 is cut circularly and a rubber grommet 346 is fitted into the circular recess. The grommets 346 of the respective rod members 344 are then fitted into the through-holes 343. The rod members 344 and the grommets 346 together define a one-touch fasteners.

The rear end portions 348 of the intake runners 114 of the intake units 118 are connected to the front end portions 350 of the throttle bodies 112 via rubber sealing members 352. As seen in FIG. 4, the sealing member 352 is detachably fitted onto the front end portions 350 of the throttle bodies 112 and then the rear end portions 348 of the intake runners 114 are detachably fitted into the sealing members 352 so as to complete air tight connections of the respective throttle bodies 112 and the intake runners 114.

Preferably, in assembling the intake units 118 with the engine 32, the respective intake runners 114 are connected to the respective throttle bodies 112 via the sealing members 352. The rod members 344, which have been already screwed down to the crankcase cover 84*b*, are then fitted into the grommets 346, which have been also put at the projections 341*b* on the plenum chamber members 116. The breather pipe 312 is also fixed to the outlet port 324 of the breather chamber 311 and the inlet port 326 of the plenum chamber 104. Finally, the connecting portions 336 of the balance pipe 332 are affixed to the respective coupling projections 342 of the plenum chamber members 116 so that the passage portion 334 of the conduit 332 is fitted into the recesses 340.

As described above, in the illustrated arrangement, the plenum chambers 104 are disposed on the opposite side of the crankshaft 88 relative to the crankcase assembly 84. In addition, the plenum chamber members 116 are positioned in close vicinity to each other. The air induction system 98 can thus have the intake passages 102 with lengths that are long as possible, which is beneficial for low speed operation of the four-cycle engine 32.

The engine 32 in this arrangement has the multiple plenum chambers 104 rather than a single plenum chamber. The respective plenum chambers 104 are required to be coupled with only the intake passages 102 on one side of the banks because the balance pipe 332 couples the plenum chambers 104 together. The arrangement thus simplifies assembling and/or maintenance work because the related components need only relatively rough accuracy in configurations and mount positions. It should be noted that each plenum chamber member 116 need not be unified with the intake runners 114.

As mentioned above, in the illustrated arrangement, the crankcase cover 84*b* defines the breather chamber 311 and preferably supports the electrical components 176, 188, 190, 192 and 194. Accordingly, the crankcase assembly 84 should be well reinforced so as to prevent inner pressure from deforming the crankcase assembly 84.

Figure 14:
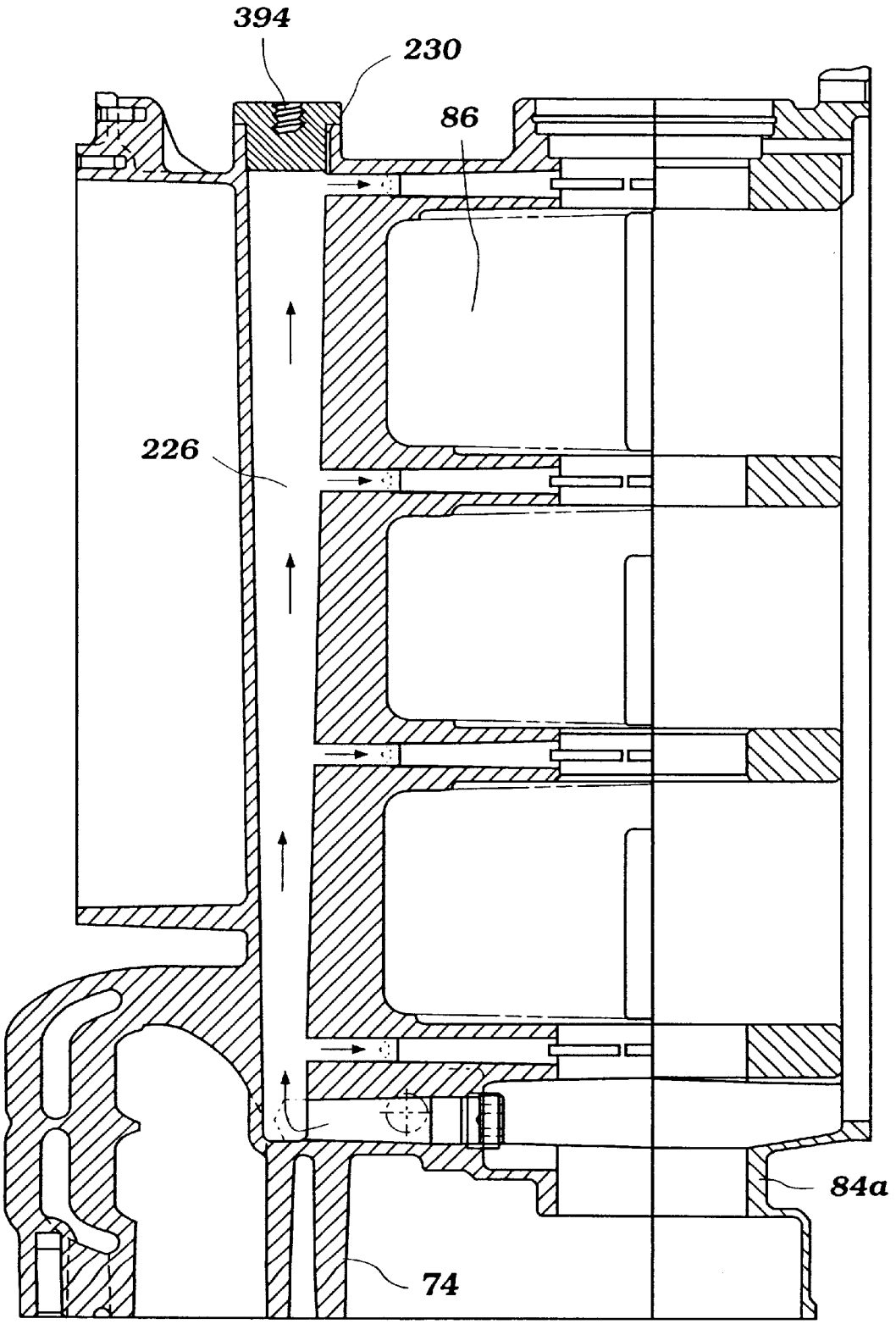
FIG. 14 is a sectional side view of a portion of the engine generally taken along a vertical plane extending through a main lubricant gallery, the cylinder block, the crankcase member and the crankcase cover.

With primary reference to FIGS. 9 and 14–20, the throttle valve linkage 126 of the illustrated engine will now be described in detail below. The valve shaft 124 on each bank has a valve lever 380, 382 positioned atop the valve shaft 124 and rigidly affixed thereto. The valve lever 380 on the starboard side bank has a lever portion 380*a*, while the other valve lever 382 on the port side has also a lever portion 382*a* which is slightly longer than the lever portion 380*a*. A manipulator or valve actuator 384 manipulates the valve levers 380, 382 and is pivotally affixed to the foregoing closure member 230. More specifically, a ring member 386 is fitted into a bottom recess of the manipulator 384 and is prevented from coming out by a snap ring 388. A bush or collar 390 is affixed to the closure member 230 by a pin 392. The ring member 386 of the manipulator 384 is fitted onto the bush 390. As best seen in FIG. 14, the closure member 230 defines a threaded recess 394. A bolt 396 is screwed down to the threaded recess 394 with the manipulator 384, which has the ring member 386, and the bush 390 both interposed therebetween. Because the ring member 386 is pivotally mounted on the bush 390, the manipulator 384 is pivotable about a pivot axis extending vertically through the closure member 230.

The manipulator 384 can be directly affixed to the cylinder block 74. Placing the manipulator 384 on the closure member 230 is, however, advantageous because no machining process to the cumbersome cylinder block 384 is necessary and the closure member 230 is typically smaller than the cylinder block 384. Also, using the closure member 230 can save manufacturing costs because another special component for affixing the manipulator 384 does not have to be prepared.

The manipulator 384 has two lever portions 384*a*, 384*b* which extend radially from the pivot axis of the manipulator 384 and are spaced apart from each other with a fixed angle. The lever portion 384*a* is larger than the other lever portion 384*b*. A coupling rod assembly 400 pivotally couples the lever portion 380*a* of the valve lever 380 with the lever portion 384*a* of the manipulator 384 via an adjustment mechanism 402, which will be described below. Another coupling rod assembly 404 directly and pivotally couples the lever portion 382*a* of the lever 382 with the lever portion 384*b* of the manipulator 384. In the illustrated arrangement, the coupling rod assemblies 400, 402 define manipulating members.

Each rod assembly 400, 404 includes a rod member 406, a pair of coupling members 408 and a pair of nuts 410. Both ends of the rod members 406 are threaded, while each coupling member 408 has a hollow end such that each the rod members can be fitted inot the coupling members 408 can be fitted. Nuts 410 are screwed onto the threaded portions before these ends are inserted into the hollows. After the threaded ends are inserted into the coupling member 408, the nuts 410 are adjusted so as to change the whole length of the rod assembly 400, 404. Fastening members 412, which have threaded end portions, are used for pivotal connection of the respective lever portions 382*a*, 384*a*, 384*b* and the adjustment mechanism 402 with the coupling members 408 of the rod assemblies 400, 404.

With primary reference to FIGS. 17–20, the adjustment mechanism 402 will now be described. The adjustment mechanism 402 includes the valve lever 380 and an adjustment member 416. The valve lever 380 has two through-holes 418, 420, while the adjustment member 416 has three through-holes 422, 424, 426. The middle hole 424 of the adjustment member 416 defines a slot. The valve shaft 124 extends through the hole 418 of the valve lever 380 and the hole 422 of the adjustment member 416. The coupling member 408 of the rod assembly 400 is coupled with the adjustment member 416 by the bolt 412 that extends through the hole 426 of the adjustment member 416 and a through-hole of the coupling member 408. A screw 428 extends through the hole 420 of the valve lever 380 and the slit 424 of the adjustment member 416 and is locked by a lock member 430. Because the hole of the adjustment member 416 is formed as the slot 424, a position of the adjustment member 416 relative to the valve lever 380 can be adjusted. If, therefore, the throttle valves 122 on both sides do not fit properly because of errors occurring in manufacturing, assembling processes and/or during in long time use, the operator can change the position of the adjustment member 416. That is, the adjustment mechanism 402 in this arrangement can adjust discrepancy in movement of throttle valves 122 on both banks so as to position them accurately.

It should be noted that the hole 420 of the valve lever 380 can define a slot instead of the hole 424 of the adjustment member 416. In the illustrated arrangement, no adjustment mechanism is interposed between both the lever portions 382*a* and the 384*b*. It is, however, practicable to provide another adjustment mechanism therebetween.

With reference back to FIGS. 9, 15 and 16, the throttle valve linkage 126 also includes a control mechanism 440 that controls the manipulator 384. The control mechanism 440 generally comprises a mount body 442, a cam member 444, a cam follower 446, a vertical shaft 448, a horizontal bevel gear 450, a vertical bevel gear 452 and a control lever 454.

Figure 16:
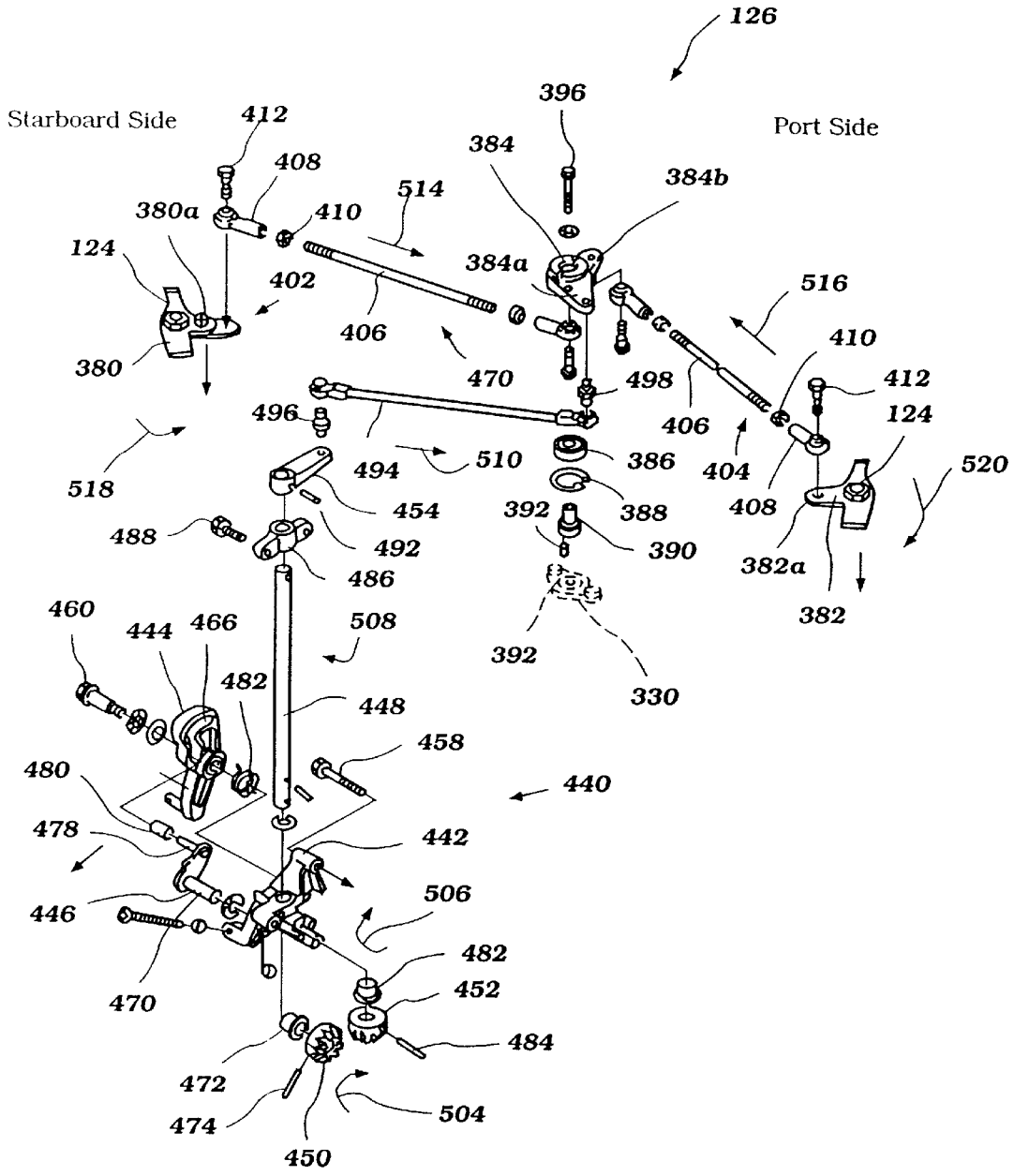
FIG. 16 is an exploded view of the throttle valve linkage.
Figure 17:
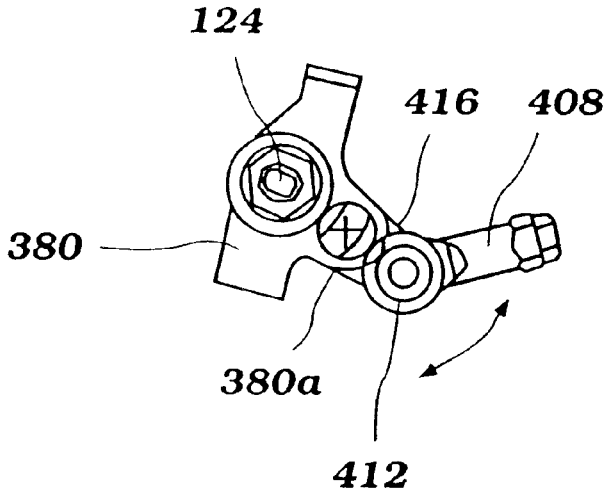
FIG. 17 is a top plan view of an adjustment mechanism of the valve linkage.
Figure 19:
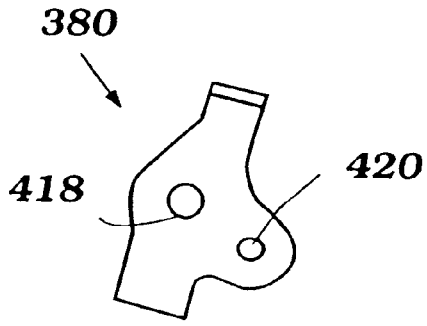
FIG. 19 is a plan view of a lever member of the adjustment mechanism.
Figure 18:
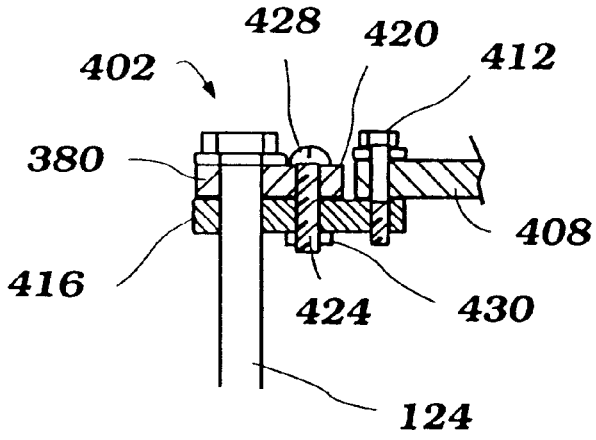
FIG. 18 is a sectional view of the adjustment mechanism.
Figure 20:
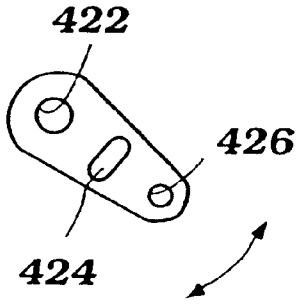
FIG. 20 is a plan view of an adjustment lever of the adjustment mechanism.

As seen in FIGS. 9, 15 and 16, the mount body 442 is mounted on a starboard side surface of the engine body 96 by a bolt 458. The mount body 442 is positioned at the lowermost intake runner 114 and slightly forward of the lowermost throttle body 112. The mount body 442 is thus placed in a space defined between the lowermost intake runner 114 and the engine body 96.

The cam member 444 is pivotally affixed to the mount body 442 by a bolt 460. The throttle cable 128 is connected to a bottom end projection 461 of the cam member 444 through a connecting rod 461 so that the cam member 444 can pivot about an axis extending horizontally, which is the same as an axis of the bolt 460, when the operator operates the throttle cable 128. A coil spring 462 is provided for biasing the cam member 444 toward a direction that is opposite to the direction in which the cam member 444 moves by the operation of the operator. The cam member 444 has a cam slot 466.

The cam follower 446 is also pivotally connected to the mount body 442. More specifically, the cam follower 446 has a connecting shaft portion 470 extending through a hole which is formed generally horizontally through the mount body 442. The end of the shaft portion 470 projects out from the through-hole and the horizontal bevel gear 450 is fitted onto this end via a bush or collar 472. The bevel gear 450 is affixed to the shaft portion 470 by a lock pin 474. The cam follower 446 is configured as a crank shape. At another end of a crank portion 476, which is located opposite side of the shaft portion 470, is a pin portion 478. A cam follower member 480 is put on this pin portion 478 and then fitted into the cam slot 466 of the cam member 444. The cam follower 446 thus pivots about an axis of the shaft portion 470 by the movement of the cam follower member 480 within the cam slot 466 when the cam member 444 is operated.

The mount body 442 also pivotally supports the vertical shaft 448. The vertical shaft 448 extends through a hole which is formed generally vertically through the mount body 442. The bottom end of vertical shaft 448 projects out from the hole downward and the vertical bevel gear 452 is fitted onto this end via a bush or collar 482. The bevel gear 452 is affixed to the vertical shaft 448 by a lock pin 484. An upper portion of the vertical shaft 448 is pivotally affixed to the side surface of the engine body 96 by a mount member 486. The mount member 486 is affixed to the engine body 96 by a pair of bolts 488. Both the bevel gears 450, 452 mesh with each other. The vertical shaft 448 thus pivots about its axis through the bevel gears 450, 452 when the cam follower 446 pivots.

The control lever 454 is affixed atop the vertical shaft 448. A lock pin 492 prevents the control lever 454 from rotating around the vertical shaft 448. A control rod 494 couples the control lever 454 with the lever portion 384*a* of the manipulator 384. One end of the control rod 494 is affixed to an end portion of the control lever 454 by a ball joint 496, while the other end of the control rod 494 is affixed to the lever portion 384*a* of the manipulator 384 by another ball joint 498. The control rod 494 is affixed to the lever portion 384*a* at a portion that is farther from the pivot axis than a portion where the rod assembly 400 is affixed.

As seen in FIG. 9, the control lever 454 is positioned lower than the timing belt 164. The control rod 494 as well as the manipulator 194 and the rod assemblies 400, 404 are therefore advantageously placed in a space between a top surface of the engine body 96 and the timing belt 164. Moreover, in the illustrated arrangement, as seen in FIGS. 9 and 15, a flywheel cover member 499 extends over the valve levers 380, 382 so as to cover whole of the throttle valve linkage 126 as well as the flywheel 184 and the timing belt 164.

When the throttle cable 128 is pulled, the connecting rod 461 moves as indicated by the arrow 500 of FIG. 9 and the cam member 444 pivots counterclockwise as indicated by the arrow 502 against the biasing force by the spring 462. The cam follower member 480 moves upwardly within the cam slot 466 and hence the shaft portion 470 of the cam follower 446 also pivots counterclockwise in FIG. 9 as indicated by arrow 502. Because of this pivotal movement of the shaft portion 470, the horizontal bevel gear 450 pivots counterclockwise in FIG. 9 and clockwise in FIG. 16 as indicated by the arrow 504 of FIG. 16.

The horizontal bevel gear 450 drives the vertical bevel gear 452, which meshes with the horizontal bevel gear 450, clockwise in a top plan view as indicated by the arrow 506 of FIG. 16. The vertical shaft 448 thus pivots clockwise in FIG. 15 as indicated by the arrow 508 of FIGS. 15 and 16. This clockwise movement of the vertical shaft 448 pushes the control rod 494 through the control lever 454 as indicated by the arrow 510 of FIGS. 15 and 16 and pivotally moves the manipulator 384 counterclockwise in FIG. 15 as indicated by the arrow 512 of FIG. 15 through the lever portion 384*a*.

The counterclockwise movement of the manipulator 384 then pulls both the rod assemblies 400, 404 as indicated by the arrows 514, 516 of FIGS. 15, 16 through the lever portions 384*a*, 384*b*. The rod assembly 400 thus moves the valve lever 380 counterclockwise in FIG. 15 as indicated by the arrow 518 of FIGS. 15 and 16, while the rod assembly 404 moves the valve lever 382 clockwise in FIG. 15 as indicated by the arrow 520 of FIGS. 15 and 16. These movements are synchronized or occur simultaneously.

The movements of the valve levers 380, 382 activate the throttle valves 122 toward open positions so as to increase the amount of air flowing through air intake passages 102. When the operator releases the throttle cable 128, the biasing force of the spring 462 returns the cam member 444 toward its initial position. All the members and components of the throttle valve linkage 126 moves in directions that are opposite to the directions indicated by the foregoing arrows 500–520. As a result, the amount of air flowing through the air intake passage decreases and the engine operates at lower speed.

As described above, in the illustrated engine is of a V-type configuration. The throttle valve linkage 126 preferably is disposed generally between the air intake conduits 114 and the engine body 96 and preferably positioned on the engine body 96. Thus, the intake conduits 114 advantageously also protect the throttle valve linkage 126 from damage that can be caused by the coupling mechanism 65 when the upper cowling is removed form the lower cowling.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an internal combustion engine, a protective cowling that surrounds the engine, the cowling comprising at least an upper portion and a lower portion, the engine comprising a cylinder block that defines a cylinder bore, a cylinder head member fixed at one end of the cylinder block and enclosing one end of the cylinder bore, a crankcase member fixed at the other end of the cylinder block and enclosing the other end of the cylinder bore, the crankcase member forming a crankcase chamber, a piston positioned within the cylinder bore, a crankshaft rotably journaled in the crankcase chamber and connected to the piston, the piston, the cylinder bore and the cylinder head together defining a combustion chamber and the cylinder block, the cylinder head member and the crankcase member together defining an engine body, a first air intake conduit communicating with the engine and extending generally along a side of the engine body, the first air intake conduit communicating with an intake silencer located proximate the crankcase member, the engine further comprising a starter motor, an electronic control unit and a fuel supply system, the fuel supply system comprising a vapor separator and a fuel injector, the starter motor, the electronic control unit, the vapor separator and the fuel injectors being located in a space defined between the intake silencer, the first air intake conduit and the engine body.

2. The engine as set forth in claim 1, wherein the starter motor and the electronic control unit are supported by the crankcase member.

3. The engine as set forth in claim 1, further comprising a rectifier regulator, a relay box, and a fuse box, wherein the rectifier regulator, the relay box, and the fuse box are also located in the space defined between the intake silencer, the first air intake conduit and the engine body.

4. The engine as set forth in claim 3, further comprising a flywheel connected to the crankshaft and a flywheel cover positioned generally above the flywheel, wherein the electronic control unit, the rectifier regulator, the relay box and the fuse box are located beneath the flywheel cover.

5. The engine as set forth in claim 3, wherein the rectifier regulator, the relay box, and the fuse box are also supported by the crankcase member.

6. The engine as set forth in claim 3, further comprising a set of wires connecting the electronic control unit, the starter motor, the rectifier regulator, the relay box, and the fuse box, the set of wires being located in the space defined between the intake silencer, the first air intake conduit and the engine body.

7. The engine as set forth in claim 1, wherein the vapor separator is interposed between the first air intake conduit and the engine body.

8. The engine as set forth in claim 1, wherein the fuel injector is interposed between the air intake conduits and the engine body.

9. The engine as set forth in claim 1, wherein the electronic control unit is interposed between the intake silencer and the engine body.

10. An outboard motor comprising an internal combustion engine, a protective cowling that surrounds the engine, the cowling comprising at least an upper portion and a lower portion, the engine comprising a cylinder block having a first cylinder bank and a second cylinder bank that are spaced apart from each other to form a V-configuration, each cylinder bank defining at least one cylinder bore, a cylinder head member enclosing one end of the cylinder bores, a crankcase member fixed at the other end of the cylinder block and enclosing the other end of the cylinder bores, the crankcase member forming a crankcase chamber, pistons positioned within the cylinder bores, a vertically extending crankshaft rotably journaled in the crankcase and connected to the pistons, the pistons, the cylinder bores, and the cylinder head member together defining combustion chambers and the cylinder block, the cylinder head member and the crankcase member together defining an engine body, a first air intake conduit communicating with a first set of intake ports that communicates with the combustion chambers of the first cylinder bank, the first set of intake ports being located on a starboard side of the first cylinder bank, the first air intake conduit extending from the first set of intake ports in a generally forward direction along a starboard side of the engine body, a second air intake conduit communicating with a second set of intake ports that communicate with the combustion chambers of the second cylinder bank, the second set of intake ports being located on a port side of the second cylinder bank, the second air intake conduit extending from the second set of intake ports in generally forward direction along the port side of the engine body, the first and second air intake conduits communicating with an intake silencer located in forward of the crankcase member which is located forward of the cylinder head member, the engine further comprising a starter motor, an electronic control unit and a fuel supply system, the fuel supply system comprising a vapor separator and a fuel injector, the starter motor, the electronic control unit, the vapor separator and the fuel injectors being located in a space defined between the intake silencer, the first air intake conduit, the second air intake conduit and the engine body.

11. The engine as set forth in claim 10, wherein the starter motor and the electronic control unit are supported by the crankcase member.

12. The engine as set forth in claim 10, further comprising a rectifier regulator, a relay box, and a fuse box, wherein the rectifier regulator, the relay box, and the fuse box are also located in the space defined between the intake silencer, the first air intake conduit, the second air intake conduit and the engine body.

13. The engine as set forth in claim 12, further comprising a flywheel connected to the crankshaft and a flywheel cover positioned generally above the flywheel, wherein the electronic control unit, the rectifier regulator, the relay box and the fuse box are located beneath the flywheel cover.

14. The engine as set forth in claim 12, wherein the rectifier regulator, the relay box, and the fuse box are also supported by the crankcase member.

15. The engine as set forth in claim 12, further comprising a set of wires connecting the electronic control unit, the starter motor, the rectifier regulator, the relay box, and the fuse box, the set of wires being located in the space defined between the intake silencer, the first air intake conduit, the second air intake conduit and the engine body.

16. The engine as set forth in claim 10, wherein the vapor separator is interposed between the second air intake conduit and the engine body.

17. The engine as set forth in claim 10, wherein the fuel injector is interposed between the first intake conduit and the second intake conduit and the engine body.

18. The engine as set forth in claim 10, wherein the electronic control unit is interposed between the intake silencer and the engine body.

19. The engine as set forth in claim 10, wherein the silencer is divided into a starboard portion and a portside portion, the starboard portion being in communication with the first air intake conduit and portside portion being in communication with the second air intake conduit.

20. An outboard motor comprising an internal combustion engine, a protective cowling that surrounds the engine, the protective cowling comprising at least an upper portion and a lower portion that are detachably coupled to each other by at least one coupling mechanism, the engine comprising a cylinder block that defines a cylinder bore, a cylinder head member fixed at one end of the cylinder block and enclosing one end of the cylinder bore, a crankcase member fixed at the other end of the cylinder block and enclosing the other end of the cylinder bore, the crankcase member forming a crankcase chamber, a piston positioned within the cylinder bore, a crankshaft rotably journaled in the crankcase chamber and connected to the piston, the piston, the cylinder bore and the cylinder head together defining a combustion chamber and the cylinder block, the cylinder head member and the crankcase member together defining an engine body, the engine further comprising a starter motor, an electronic control unit and a fuel supply system, the fuel supply system comprising a vapor separator and a fuel injector, the outboard motor further comprising means for protecting the starter motor, the electronic control unit and the vapor separator from damage caused by the at least one coupling mechanism when the upper portion of the protective cowling is separated from the lower portion.

21. The engine as set forth in claim 20, further comprising a rectifier regulator, a relay box, and a fuse box, and the means for protecting the starter motor the electronic control unit, and the vapor separator from damage also protect the rectifier regulator, the relay box, and the fuse box from damage.

22. The engine as set forth in claim 21, further comprising a set of wires connecting the electronic control unit, the starter motor, the rectifier regulator, the relay box, and the fuse box, wherein the means for protecting the starter motor the electronic control unit, and the vapor separator from damage also protect the set of wires.

* * * * *